US009790708B2

(12) United States Patent
Clark et al.

(10) Patent No.: US 9,790,708 B2
(45) Date of Patent: Oct. 17, 2017

(54) MAGNETIC LATCH

(75) Inventors: Anthony John Clark, Cremorne (AU); Neil Dunne, Davidson (AU)

(73) Assignee: D & D Group Pty. Ltd., Brookvale (AU)

( * ) Notice: Subject to any disclaimer, the term of this patent is extended or adjusted under 35 U.S.C. 154(b) by 85 days.

(21) Appl. No.: 12/144,164

(22) Filed: Jun. 23, 2008

(65) Prior Publication Data

US 2008/0296915 A1 Dec. 4, 2008

Related U.S. Application Data

(63) Continuation-in-part of application No. 11/034,487, filed on Jan. 13, 2005, now Pat. No. 7,390,035.

(30) Foreign Application Priority Data

Feb. 24, 2004 (AU) ..... 2004900908

(51) Int. Cl.
*E05C 17/56* (2006.01)
*E05C 19/16* (2006.01)
(Continued)

(52) U.S. Cl.
CPC ..... *E05B 13/101* (2013.01); *E05B 15/101* (2013.01); *E05B 63/20* (2013.01);
(Continued)

(58) Field of Classification Search
CPC .. E05B 65/0007; E05B 15/0073; E05C 17/56; E05C 19/16; E05C 19/163
(Continued)

(56) References Cited

U.S. PATENT DOCUMENTS 390,507 A * 10/1888 Morton ..... 292/179
939,174 A * 11/1909 Schlapbach ..... 292/150
(Continued)

FOREIGN PATENT DOCUMENTS

DE 3205224 A1 8/1983
JP 3212589 9/1991
(Continued)

OTHER PUBLICATIONS

European Search Report dated Dec. 21, 2007 for related Application No. EP 05 25 0200.

*Primary Examiner* — Carlos Lugo
(74) *Attorney, Agent, or Firm* — Kelly & Kelley, LLP

(57) ABSTRACT

A magnetic self-latching device for a gate has a main body with handles on either side for operation or has an arrangement to be remotely actuated. A latching body has a high strength magnet usually provided at the bottom of a cavity which defines a latching shoulder. The latching body is adapted to be fixed to a gate post. The main body, with its housing, can be mounted on the gate frame and incorporates a latch pin which, in the door-closed position, is displaced by magnetic attraction to an extended latching position and against the biasing of a return spring. The gate cannot be opened until actuation of the mechanism occurs, for example by rotating a handle to retract the pin against the magnetic force; the gate can then be swung open. When the handle is released, the biasing spring retains the latch pin in a retracted position.

19 Claims, 24 Drawing Sheets

CLOSED - MAGNET HOLDS PIN DOWN

(51) Int. Cl.

| | |
|---|---|
| ***E05B 13/10*** | (2006.01) |
| ***E05B 15/10*** | (2006.01) |
| ***E05B 63/20*** | (2006.01) |
| ***E05C 1/06*** | (2006.01) |
| *E05B 15/00* | (2006.01) |
| *E05B 47/00* | (2006.01) |
| *E05B 53/00* | (2006.01) |
| *E05B 65/00* | (2006.01) |

(52) U.S. Cl.
CPC ..... *E05C 1/06* (2013.01); *E05C 19/163* (2013.01); *E05B 15/0073* (2013.01); *E05B 47/0012* (2013.01); *E05B 53/003* (2013.01); *E05B 65/0007* (2013.01); *E05B 2047/0017* (2013.01); *E05C 17/56* (2013.01); *E05C 19/16* (2013.01); *Y10T 292/11* (2015.04)

(58) Field of Classification Search
USPC ..... 292/150, 163, 251.5, 340, 341.15
See application file for complete search history.

(56) References Cited

U.S. PATENT DOCUMENTS

| | | | | | |
|---|---|---|---|---|---|
| 995,232 | A | * | 6/1911 | Edgar | 292/189 |
| 2,219,186 | A | | 10/1940 | Hornfeck | |
| 2,370,691 | A | | 3/1945 | Schlage | |
| 2,514,927 | A | | 7/1950 | Bernhard | |
| 2,586,900 | A | * | 2/1952 | Alderman | 292/74 |
| 2,615,744 | A | | 10/1952 | Colonna | |
| 2,726,891 | A | | 12/1955 | Gresham et al. | |
| 2,765,648 | A | * | 10/1956 | Hatcher | 70/264 |
| 2,797,655 | A | | 7/1957 | Morehouse | |
| 2,988,389 | A | | 6/1961 | Wilson | |
| 3,273,925 | A | | 9/1966 | Graham | |
| 3,314,707 | A | | 4/1967 | Van Donselaar | |
| 3,334,936 | A | | 8/1967 | Wilhelmus et al. | |
| 3,350,127 | A | | 10/1967 | Maarten | |
| 3,516,701 | A | | 6/1970 | Graham | |
| 3,794,366 | A | * | 2/1974 | Graham | 292/144 |
| 3,843,174 | A | * | 10/1974 | Bogunovich et al. | 292/166 |
| 4,049,304 | A | * | 9/1977 | Imhoff | 292/333 |
| 4,118,055 | A | | 10/1978 | Bischoff, Jr. | |
| 4,702,506 | A | * | 10/1987 | Iimura | 292/251.5 |
| 5,029,912 | A | | 7/1991 | Gotanda | |
| 5,092,637 | A | * | 3/1992 | Miller | 292/173 |
| 5,362,116 | A | | 11/1994 | Doyle et al. | |
| 5,876,073 | A | | 3/1999 | Geringer et al. | |
| 6,174,005 | B1 | | 1/2001 | Norton | |
| 6,398,445 | B1 | * | 6/2002 | Matali Badia | 403/109.6 |
| 6,474,120 | B1 | * | 11/2002 | Wadsworth et al. | 70/276 |
| 6,666,435 | B2 | * | 12/2003 | Blosfelds | 256/73 |
| 6,733,049 | B2 | | 5/2004 | Piorkowski et al. | |
| 7,044,511 | B2 | | 5/2006 | Kliefoth et al. | |
| 7,100,405 | B2 | * | 9/2006 | West | 70/100 |
| 7,390,035 | B2 | * | 6/2008 | Karcz et al. | 292/163 |
| 7,472,569 | B2 | * | 1/2009 | Talpe | 70/210 |
| 7,766,399 | B2 | * | 8/2010 | Howey | 292/251.5 |
| 2005/0210938 | A1 | * | 9/2005 | Doyle et al. | 70/276 |
| 2007/0007773 | A1 | | 1/2007 | Berkseth et al. | |
| 2011/0148126 | A1 | * | 6/2011 | Macernis | 292/251.5 |

FOREIGN PATENT DOCUMENTS

| | | |
|---|---|---|
| JP | 8210001 | 8/1996 |
| WO | 9203631 | 3/1992 |

* cited by examiner

CLOSED - MAGNET HOLDS PIN DOWN

OPEN - MAGNET MOVES AWAY FROM PIN ALLOWING SPRING TO LIFT PIN

MAGNETIC LATCH

CROSS-REFERENCES TO RELATED APPLICATIONS

This application is a continuation-in-part of pending application Ser. No. 11/034,487 filed on Jan. 13, 2005.

FIELD OF THE INVENTION

The present invention relates to magnetic latches suitable for use on gates or doors where automatic latching is required when the gate or door is displaced to a position at which it is to be latched. An actuator is provided for unlatching so that the gate or door can be opened, usually pivotally, away from its latching position.

The present invention in various embodiments offers new and useful alternatives to previously available options and indeed lends itself to embodiments which may incorporate security locks such as quality cylinder locks.

BACKGROUND OF THE INVENTION

A significant development in magnetic latching and devices is the subject of the PCT International Publication W092/03631 on the basis of which U.S. Pat. No. 5,362,116 was issued to David Doyle and Neil Dunne, the contents of which are fully incorporated herein by reference. This invention has been assigned to the assignees of the present invention. The Doyle and Dunne invention relates to a vertically operating magnetic latch particularly for a swimming pool gate with a lost motion arrangement so that a latching pin, after manual retraction and after opening the gate, is retained in an elevated retracted position by spring biasing and the actuating mechanism does not apply downward load-imposing forces against the biasing spring.

While this device has been successfully exploited, the present invention has been conceived to offer novel inventive and alternative embodiments for different applications in a different form. Indeed the present invention may be applied to provide magnetic latching as an alternative to conventional striker plates with spring door latches and the invention may lend itself to versions incorporating locks.

Embodiments of the present invention are envisaged as extending both to manually actuatable versions (such as embodiments having rotatable rotary knobs or rotatable handles) but also extends to actuation by other means such as solenoids or electric motors permits actuation from a remote location. Of particular significance in these embodiments is the inherent characteristics of magnetic latching as demonstrated by the Doyle and Dunne prior patent whereby when a gate or door is swung to its closed position, in contrast to conventional gate latches where force is required to displace a spring biased latch pin initially away from a latching position prior to it entering into latching engagement, with Doyle and Dunne there is no such resistance. This is especially valuable in installations having an automatic door closing device.

SUMMARY OF THE INVENTION

The present invention is embodied in a self-latching device for latching, in a predetermined position, two members which are otherwise moveable relative to one another, the device comprising a latch arm and a retaining element which in use provides a latching shoulder for the latch arm to prevent relative movement of the members, at least one of the latch arm and the retaining element providing a magnetic field and the other having magnetic properties, the latch arm being arranged to be displaceably mounted on a first of said members and the retaining element being arranged to be associated with the second of said members, the latch arm and retaining element undergoing relative movement into a latching position under the influence of the magnetic field when the members are in the predetermined position, and then relative movement of the two members is substantially prevented by an engagement portion of the latch arm and latching shoulder interengaging, and the latch arm being displaceable under applied force away from the retaining element to a retracted position so that the members may be moved apart, the device further comprises:

(a) a resilient biasing element associated with the latch arm to bias it towards the retracted position, but with a biasing force on the latch arm which is less than the force imparted on the latch arm by the magnetic field when the members are located in the predetermined position;

(b) an actuator movably mounted on the housing and extending from the housing transversely to the path of displacement of the latch portion for receiving a displacement force to displace the latch arm from its latching position to its retracted position, whereby the two members may be moved apart away from the predetermined position;

(c) a connector for connecting the actuator and the latch arm to displace the latch arm from its latching position to its retracted position and to leave the actuator free to move relative to the connector; and (d) a second biasing element for returning the actuator to its initial position on removal of the displacement force leaving the biasing element to maintain the latch arm and connector substantially in its retracted position, whereby when in the predetermined position the latch arm is displaceable under the magnetic forces against the biasing means to re-establish its latching position.

Implementation of the invention may be by including a lost motion interconnection between the actuator and the latch arm whereby no significant load is applied to the latching arm and its biasing element when in the retracted position.

In the subject invention, the actuator may be designed so as to be movable in a rectilinear, arcuate or rotary manner either in or transverse to a plane in which the latch arm is to be displaced.

A particular embodiment is one wherein the latch arm is mounted for reciprocation in a housing and the housing also mounts the actuator in the form of a rotary actuator which may include a conventional rotatable handle, with the option of providing one handle on either side of the device, for example to be disposed on either sides of a gate. Each handle might incorporate a locking mechanism such as a wafer lock or cylinder lock for security reasons. The housing might incorporate an alternative locking mechanism.

One embodiment provides a carriage with spaced guides along which mounting elements of the latch arm can slide, the latch arm incorporating a pin around which a helical compression biasing spring is mounted as the biasing means. In such an embodiment a torsion spring can be provided as the restoring means for the rotary actuating means (such as the handles).

As described with reference to an illustrated embodiment, the latch arm can take the form of a generally C-shaped carriage which moves in guides in the housing and the C-shaped carriage has lobes at its open ends for engagement with corresponding projecting elements associated with a barrel connected to a rotatable handle.

An alternative approach, however, is to provide the latch arm with a drum-like structure around which a flexible connection element extends. The arrangement is such that the element is extended and perhaps tensioned when the latch arm is in the latching position and rotation of the drum by the actuator causes the latch arm to be retracted. The arrangement is such that after movement of a gate (or door) to an open position, the biasing means retains the latch arm in its retracted position and tension previously applied to the flexible element is relieved so that no or only negligible load is applied against the biasing means.

The device may include an actuator for displacing the latch arm by remote actuation for remote gate opening control. However, larger markets are thought to be for directly operated gate latches having handles.

Embodiments of the invention can be formed into a volume, shape and configuration consistent with conventional cylinder lock door locks, i.e. within an envelope of about 15 cm×10 cm×5 cm.

Embodiments may have the magnet material provided by a permanent magnet having a remanence (residual flux density) of about 12 kilogauss and the latch arm has a pin having magnetic properties and of transverse dimension of about 8 mm, preferably sealed within the body of the retaining element and the latch arm then has a steel pin providing the latching portion and of a suitable grade of steel having magnetic properties.

In place of a rotatable knob or rotatable handle for actuating means, the invention lends itself to embodiments which are remotely actuated, for example electrically by the use of a solenoid arrangement or motor to cause rotation of the actuator for retraction of the latching arm.

Generally arrangements incorporate a lost motion interconnection between the actuator and the latch arm such that little or preferably no load is applied to the latching arm and its biasing means when in the retracted position.

Although significant markets for embodiments of the invention are perceived to be for gate locks incorporating key actuated mechanisms such as wafer locks or cylinder locks, embodiments may be simply no-lock latch mechanisms, or embodiments having an egress button on one handle and a lock on the other.

Embodiments can provide a lost motion effect by having an eccentric drive pin to be displaced upon lock actuation to displace an internal element from a retracted position (where it rotates freely upon handle rotation) to an extended position in which it engages with a collar to rotate the collar and the collar in turn displaces a carriage to retract the latch arm.

The term "comprising" (and its grammatical variations) as used herein are used in the inclusive sense of "having" or "including" and not in the sense of "consisting only of." Other features and advantages of the invention will become apparent from the following detailed description, taken in conjunction with the accompanying drawings which illustrate, by way of example, the features of the invention.

In one embodiment, the present invention provides a magnetic latch comprising a first unit and a second unit adapted to be mounted on respective structures (such as a gate post and gate) which are relatively moveable with respect to each other but intended to be latched in a closed position; the first unit has a displaceable latch element displaceable along a first path and has biasing means to bias the latch element to a latching position, the latch element being displaceable against the biasing to a retracted position in operation; the second unit has a retractable element and engagement means for engaging in latching engagement a portion of the displaceable latch element of the first unit when in the latching position, the retractable element being retractable along a second path transverse to the first path, the second unit further having biasing means to bias the retractable element to a retracted position; the magnetic latch has magnetic means associated with the displaceable latch element and with the retractable element so that in use when the structures are in the closed position, the juxtaposition of the latch element and the retractable element causes magnetic forces to displace the latch element against its biasing to establish the latching engagement, and the magnetic latch has retraction means selectively operable to retract one of the latch element and the retractable element whereby the requisite juxtaposition for magnetic attraction between the latch element and the retractable element ceases, thereby permitting the structures to be moved from the closed position.

In another embodiment, the invention may be defined as a magnetic latch having first and second units adapted to interengage in use in latching engagement to hold a moveable structure (such as a door) in a closed position relative to another structure (such as a door post), the latch having a magnetic arrangement in the first and second units to cause components thereof to be displaced to establish latching engagement under magnetic forces when the components are in juxtaposition for latching at the closed position, the first unit having (a) a component of the magnetic arrangement biased towards a position in which magnetic attraction occurs for establishing latching engagement with the second unit, (b) an actuator operable to displace the component against the biasing to cause removal of the magnetic attraction for unlatching, and (c) a latching structure to co-operate in latching engagement with the second unit, and the second unit having a component of the magnetic arrangement provided in a retractable element which is biased towards a retracted position away from a latching position in which latching engagement with the latching structure of the first unit can occur.Xx In one form the actuator is movable along a second path transverse to the first path of movement of the retractable element of the second unit and the component is a permanent magnet. Furthermore the second unit may have its retractable element movable in a direction at right angles to the first path, and of an material which is attracted to the magnet.

However both components of the magnetic arrangement could be permanent magnets with opposite poles adjacent to one another is the latching position.

In another embodiment, the first unit may have a rotatable mounted permanent magnet, and the second unit has a permanent magnet associated with the retractable element, the actuator being adapted to rotate the magnet of the first unit so that magnetic repulsion occurs with the magnet of the second unit to bias the retractable element towards its retracted position and unlatching occurs.

Biasing can generally include resilient biasing, for example using a compression spring either alone or as an aid to gravity or alone or in combination with magnetic biasing. Embodiments include using magnetic biasing.

In one important application, the magnetic latch has its first unit adapted to be mounted on a gate with a horizontally displaceable actuator (which may be moved by a rotatable handle or otherwise) and which mounts a magnet, which is normally in a projected position under biasing, and the second unit has a vertically retractable magnetically attractable latching element, biased vertically away from a complementary latching element of the first unit but arranged to be magnetically attracted by the magnet to establish latching but moveable under its biasing when the actuator is driven to retract the magnet.

It will be appreciated that the prevent invention lends itself to various embodiments.

In an illustrative embodiment described hereinafter with reference to the accompanying drawings, a particular form will be given where the first unit is adapted to be mounted on a gate and retraction for unlatching is provided for by the use of rotatable handles on both sides of the gate or if preferred just one side, the first unit carrying a high coercitivity permanent magnet which is biased to a projected positing for latching purposes.

The first unit also has a projection defining a rigid cavity for receiving in latching engagement under magnetic forces the retractable element of the second unit.

In one embodiment biasing is by a helical spring but other spring arrangements could be used within the scope of the invention and indeed the assistance of gravity could be adopted. For example, the embodiment described later with reference to the drawings could be installed in an inverted position where gravity aids the retractable element to then descend away from the latching cavity.

Although the magnetic arrangement can be achieved with one component having a high coercivity magnet and the other being of magnetic material such as steel, both components could contain magnet with appropriate polarity for attraction purposes.

In a simple application, the invention may be embodied in arrangements that purely provide for a manually operable system for achieving an unlatching whereby the gate or door can be opened. However embodiments of the invention lend themselves to remote actuation, for example by electromagnetic actuation. This might be particularly valuable for security gates or the like. Although the illustrative embodiment does not include security locks, such features can be included if desired in a conventional manner for the handles.

It would be appreciated that embodiments of the invention can be particularly or advantageous with gates and doors of a general nature, although embodiments of the invention could be subject of adaptations, particularly to meet the safety requirements of swimming pool gates and the like. Regulations for swimming pool gates require that they are outwardly opening, and that the location of the displacement element for opening or unlatching the gate must be out of reach of a child of less than a certain height.

Thus, an adaptation of the embodiment shown in the drawings for swinging gates could be to omit the front handle and have a plain casing and to mount the latch well below the upper portion of the gate so it can only be actuated by leaning over the gate and reaching down to open the gate.

The magnetic latch shown in the drawings is particularly suitable for mounting on a conventional pivotal gate or door but the unit could also be installed on a sliding door.

BRIEF DESCRIPTION OF THE DRAWINGS

The invention will be further exemplified with reference to the accompanying drawings of which.

DETAILED DESCRIPTION OF THE INVENTION

Figure 1A:
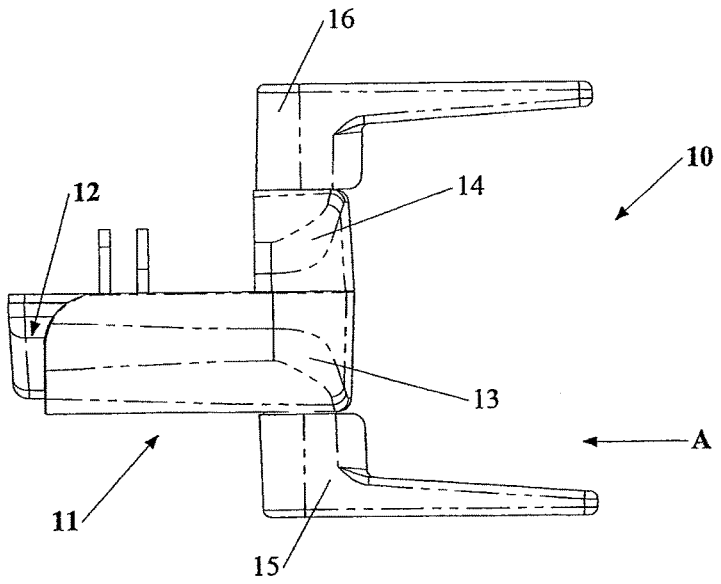
FIGS. 1A, 1B and 1C are respectively a plan view, a front elevation and an end elevation (in the direction of arrow A in FIG. 1A) of an embodiment of the invention suitable for fitting to a gate.
Figure 1B:
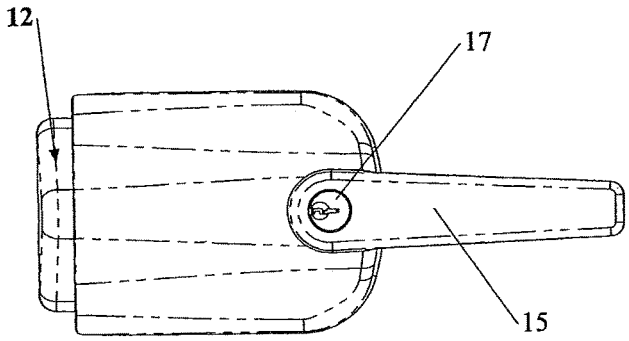
Figure 1C:
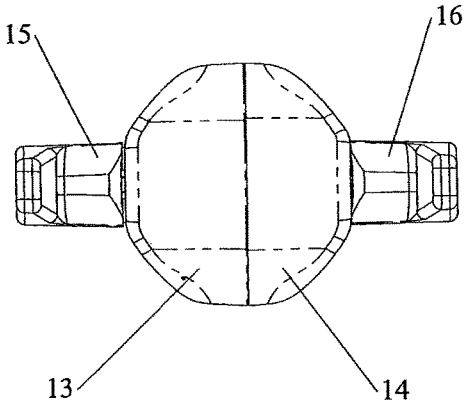

The gate latch generally shown in FIGS. 1A to 1C is shown in assembled form and prior to installation. The latch 10 comprises a lockable latch module 11 to be mounted on a post of a gate and a receiving latch block 12 which is adapted to be mounted to a fixed gate post.

The latch module has a front casing 13 and a rear casing 14 adapted to be mounted on opposite sides of gate post. Front and rear handles 15 and 16 are provided and a security cylinder lock 17 is provided for each handle for independent locking purposes.

Figure 2:
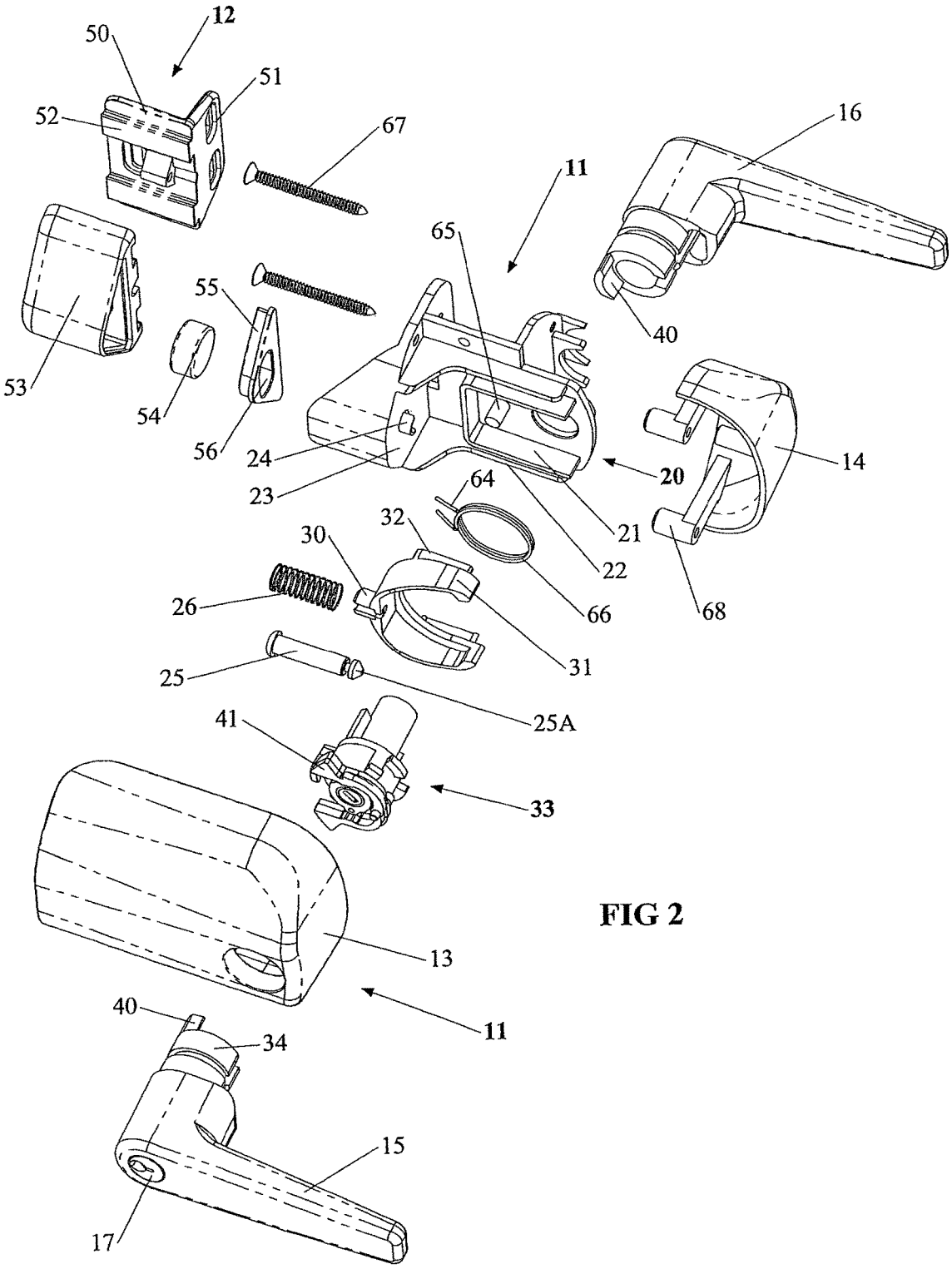
FIG. 2 is an exploded view of the device of the embodiment of FIGS. 1A to 1C.

The components are shown in more detail in FIG. 2. A mounting structure 20 is provided for attachment to a gate post of rectangular cross-section and to mount the components within the casings 13 and 14 and to mount the handles 15 and 16. The mounting structure 20 includes a back plate 21 having spaced parallel grooves 22 to guide a latch pin assembly, and an integral end wall 23 having a small collar 24 around an aperture (not shown) through which a latching pin 25 can move. A helical compression spring 26 is mounted on the latching pin and the right hand end of the latching pin 25 upon assembly is attached by engagement in a cylindrical projection 30 of a generally C-shaped carriage 31. The carriage 31 has integral parallel guide strips 32 extending from its rear face provided for sliding engagement in the grooves 22 in the back plate 21.

An actuating barrel 33 (as shown in more detail in FIGS. 3 and 4) is to be rotated by the handles and displace the carriage axially relative to the latching pin 25. The barrel engages with an end portion 34 of a front handle 15 after the end portion is assembled by passing through an aperture in the front casing 13. An arcuate tab 40 projects from the end portion 34 to engage a slot in the barrel 33 so as to transmit rotation. The barrel 33 extends through an aperture in the back plate 21 to be connected to an end portion 35 of the rear handle 16. An arcuate tab 40 also engages with a slot on the rear of the barrel 33 to transmit rotation.

Figure 3:
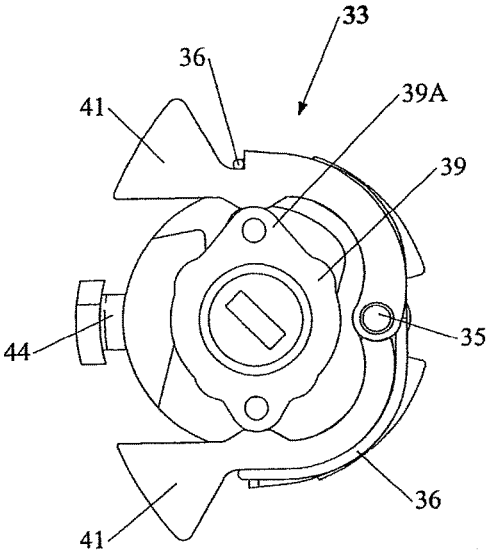
FIG. 3 is an end view of an actuating barrel of the device on an enlarged scale.

As best seen in FIG. 3, the actuating barrel 33 has a rectangular shaped through-aperture 38 for receiving a conventional actuating bar which extends from the rear of a cylinder lock 17. The barrel has a structure which permits rotation of the barrel only when the key has been turned to unlock the lock 17, as now described with reference to FIGS. 3 and 4.

The rear end of the barrel 33 has a groove 39 for accommodating the corresponding arcuate tab 40 from the rear handle so that rotary motion is transmitted to the barrel 33 when the latch is assembled and either handle is rotated. A similar groove 39A is provided on the front of the barrel for the arcuate tab 40 of the front handle. The barrel assembly includes upper and lower ears 41 at the ends of pivotal arms 34 which are mounted on pivot pin 35 with a C-shaped spring clip 36 fitted over the arms 34 to bias them radially inwardly so that recess 37 in the inner periphery of each arm rest on lobes 39A of a rotor 39. The recess provides a detent function to define positively the position shown.

Figure 4:
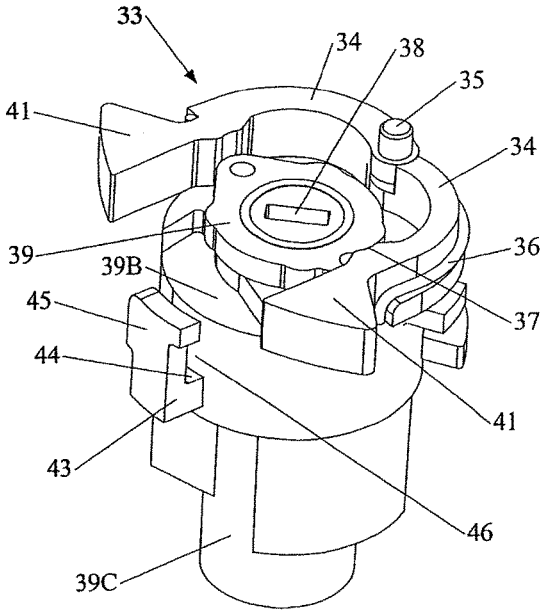
FIG. 4 is an isometric view of the actuating barrel on an enlarged scale.
Figure 7:
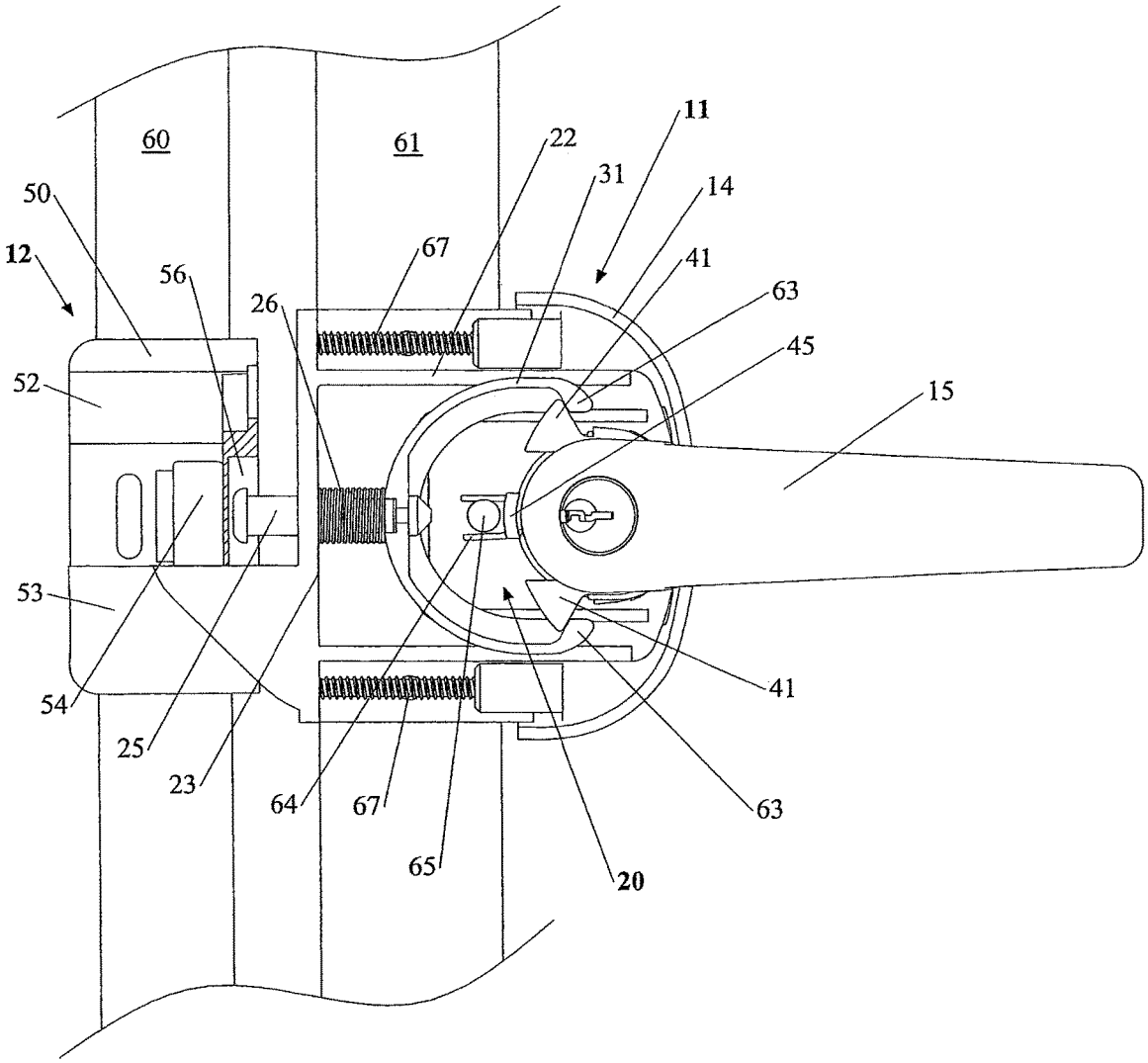
FIG. 7 is an exploded isometric view of the latch of FIG. 1.

A middle portion of the barrel has an L-shaped bracket 43 for retaining end pins 64 of a torsion spring 66 (not shown in FIGS. 3 and 4 but shown in FIGS. 2 and 7). The L-shaped bracket has a mounting leg 44 and an arcuate base 45 with a groove 46 for accommodating the body of the torsion spring 66.

Figure 5:
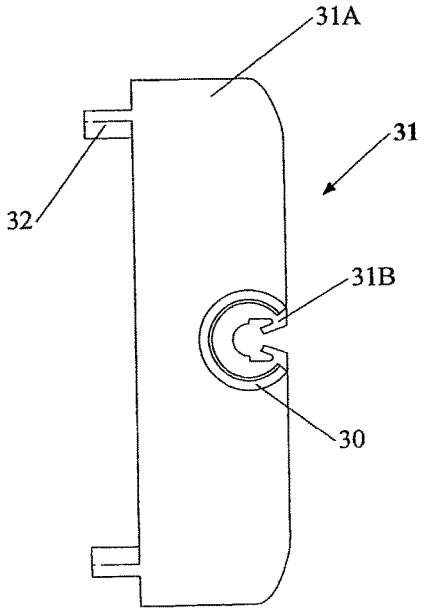
FIG. 5 is an end elevation of a sliding carriage of the latch arm on an enlarged scale.
Figure 6:
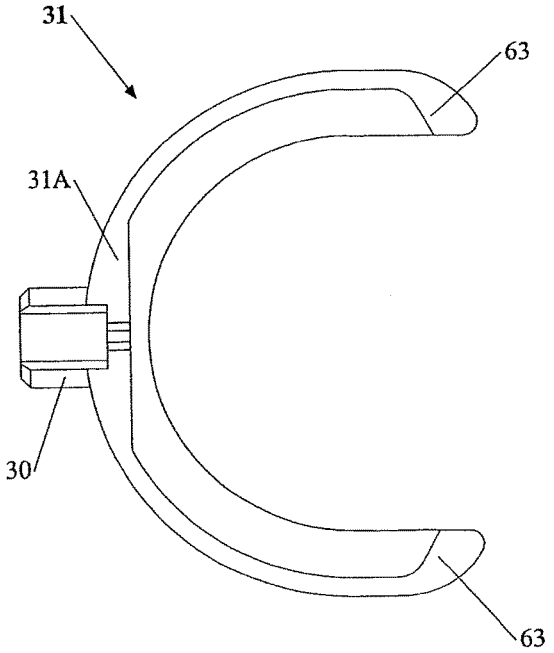
FIG. 6 is an elevation of the sliding carriage of FIG. 5.

FIGS. 5 and 6 show detail of the carriage 31 which has a central wall 31 A and the part cylindrical projection 30 accommodating a spring locking tag 31B into which a groove 25A near the rear of latching pin 25 is snap-fitted. The carriage 31 has inwardly directed lobes 63 for receiving a displacement force when either is engaged by an ear 41 of an arm 42 as described below.

Figure 8:
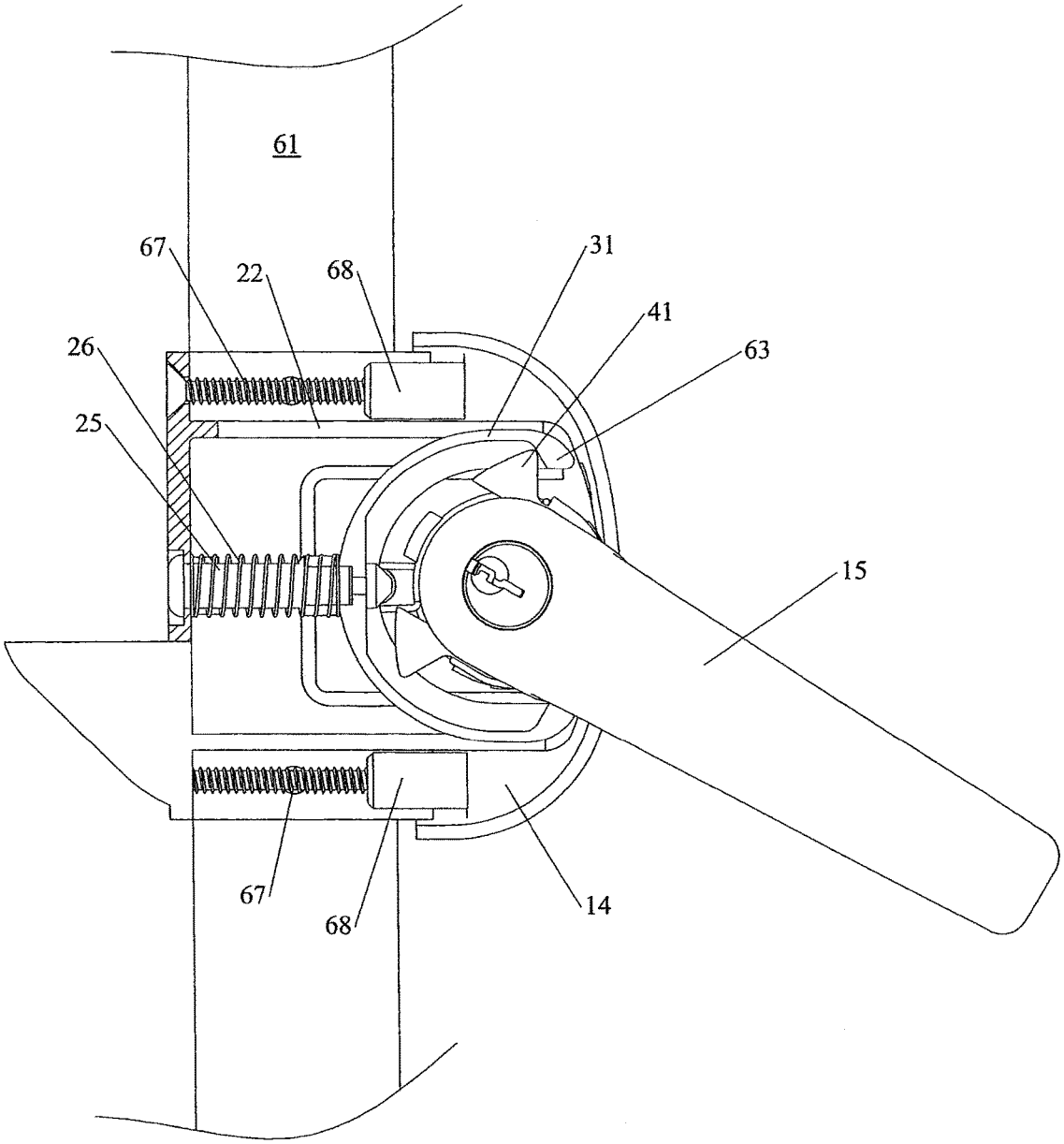
FIG. 8 is an exploded perspective view of a second embodiment with a rotary magnetic mounting for unlatch.

FIG. 3 shows the configuration when the lock 17 has been unlocked so that the ears 41 project and upon rotation of the handle, as shown in FIG. 8, upper ear 63 is engaged and the carriage moved rectilinearly to the right.

Referring now to FIG. 7, the latching block 12 is shown mounted to a fixed gate post 60 and the latching module 11 is shown mounted to an end post 61 of a gate. The latching block 12 is shown in part-sectional view and the latching module is shown with the front casing removed for clarity. In the configuration shown in FIG. 7, the handles have been released and are arranged horizontally by the effect of a torsion spring 66 (shown in FIG. 2) and mounted on the barrel 33. FIG. 7 shows the device in the predetermined position, i.e. the latching position at which the latch pin 25 has been magnetically attracted to extend so that the tip of the latch pin engages in the aperture 56. The spring 26 is compressed between the interior of the end wall 23 and the carriage 31. The carriage is thus drawn to the left and the lobes 63 of the carriage are adjacent to or engage with the ears 41 of the actuating barrel 33, since in this configuration the lock is unlocked.

However, when the lock is locked, the rotor 39 is rotated and the lobes 39A disengage the arms 34 which displace inwardly under the pressure of the spring clip 36. If the handle 15 is displaced, the ears 41 do not engaged the lobes 63 of the carriage and the carriage does not move.

FIG. 7 also shows the end pins 64 of the torsion spring which engage of a location pin 65 which extends from the back plate 21.

The components of the latching block 12 are more clearly shown in exploded view in FIG. 2.

The components comprise an L-shaped mounting plate 50 adapted to be secured to a post by screws passing through apertures 51 on an end face. The mounting plate has dovetail section tracks 52 for engaging slidingly with complimentary shaped grooves on the rear of a latch body 53. The latch body has a central cavity for accommodating a high strength magnet 54 which is held in position and the cavity sealed with suitable sealant when a cover element 55 is secured in place. The element 55 has a suitable shaped aperture 56 having a latching function when engaged with the tip of latching pin 25.

Main fixing screws 67 (shown more clearly in FIG. 8) extend through the end wall 23 of the mounting structure 20 and into tapped receiving arms 68 of the rear housing 14.

Although not shown in the drawing, the rear of the front housing 11 is provided with spaced mounting lugs having cylindrical bores through which the mounting screws 67 also extend to achieve assembly. FIG. 8 shows downward rotation of the handle 15, typically after manual unlocking and depression of the handle. The actuating barrel 33 retracts the carriage 31 by virtue of engagement of the upper ear 41 with the upper lobe 63 of the carriage thereby displacing it to the right as shown in FIG. 8. The pin 25 is thus retracted to the position shown in FIG. 8 and is removed from engagement with the cavity 56 of the receiving block. The gate can then be swung open and, when the handle is released, because there is no magnetic field influence, the carriage 31 remains in its position under biasing of the spring 26 and leaving the latch pin 25 retracted.

Figure 9:
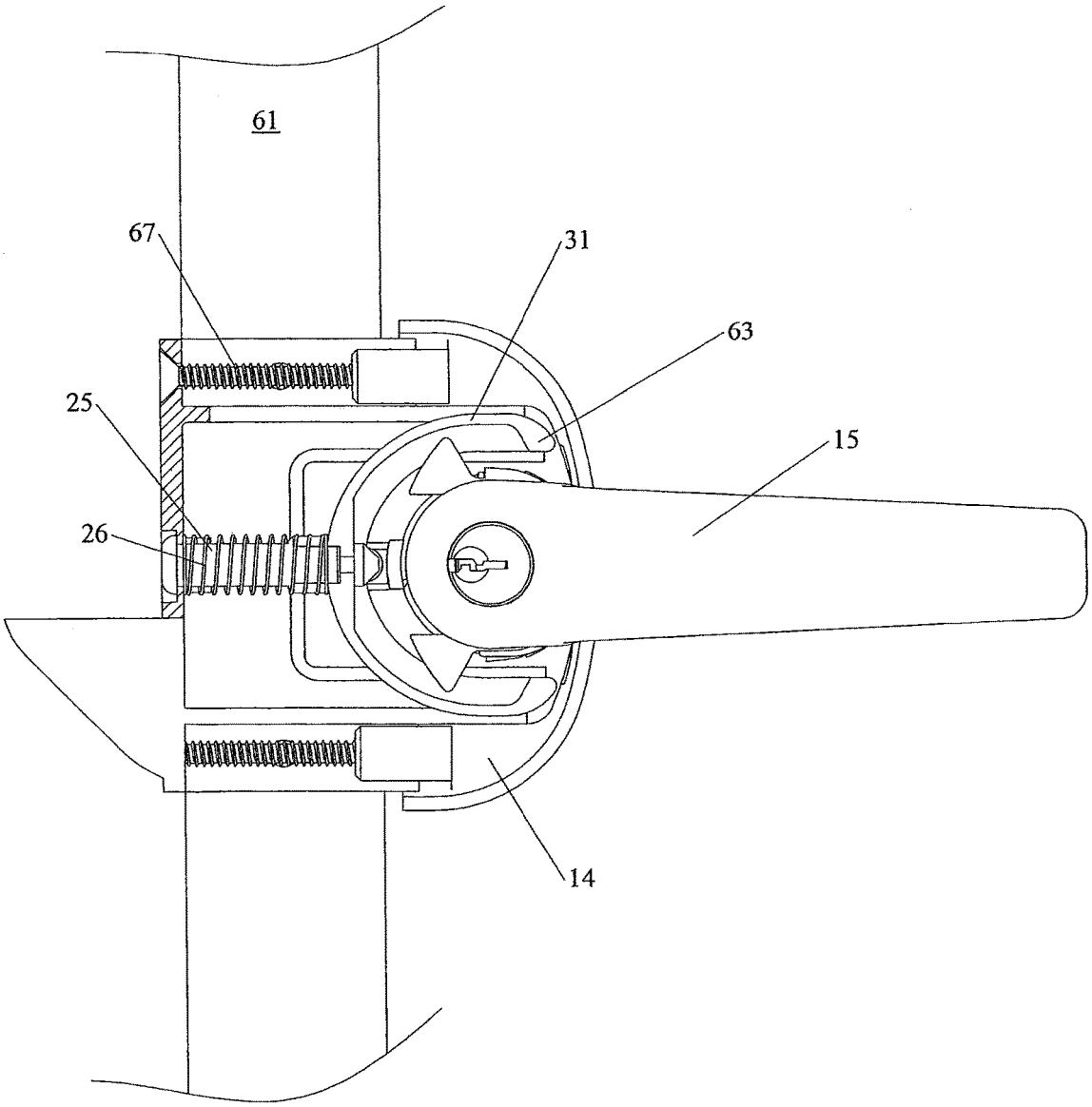
FIG. 9 is a view corresponding to FIG. 8 but after release of the handle to return to its normal position and with the latch pin retained in a retracted position.

FIG. 9 shows the handle returned to its original position under influence of the torsion spring 66 with the carriage 32 in its right hand displaced position.

As and when the gate is returned to its closed position, the latch pin 25 again becomes aligned with the receiving cavity 56 and is then attracted under the strong magnetic field to move to the left thereby compressing the biasing spring 26 and sliding the carriage 32 to the left so that the configuration of FIG. 7 is attained.

Figure 10:
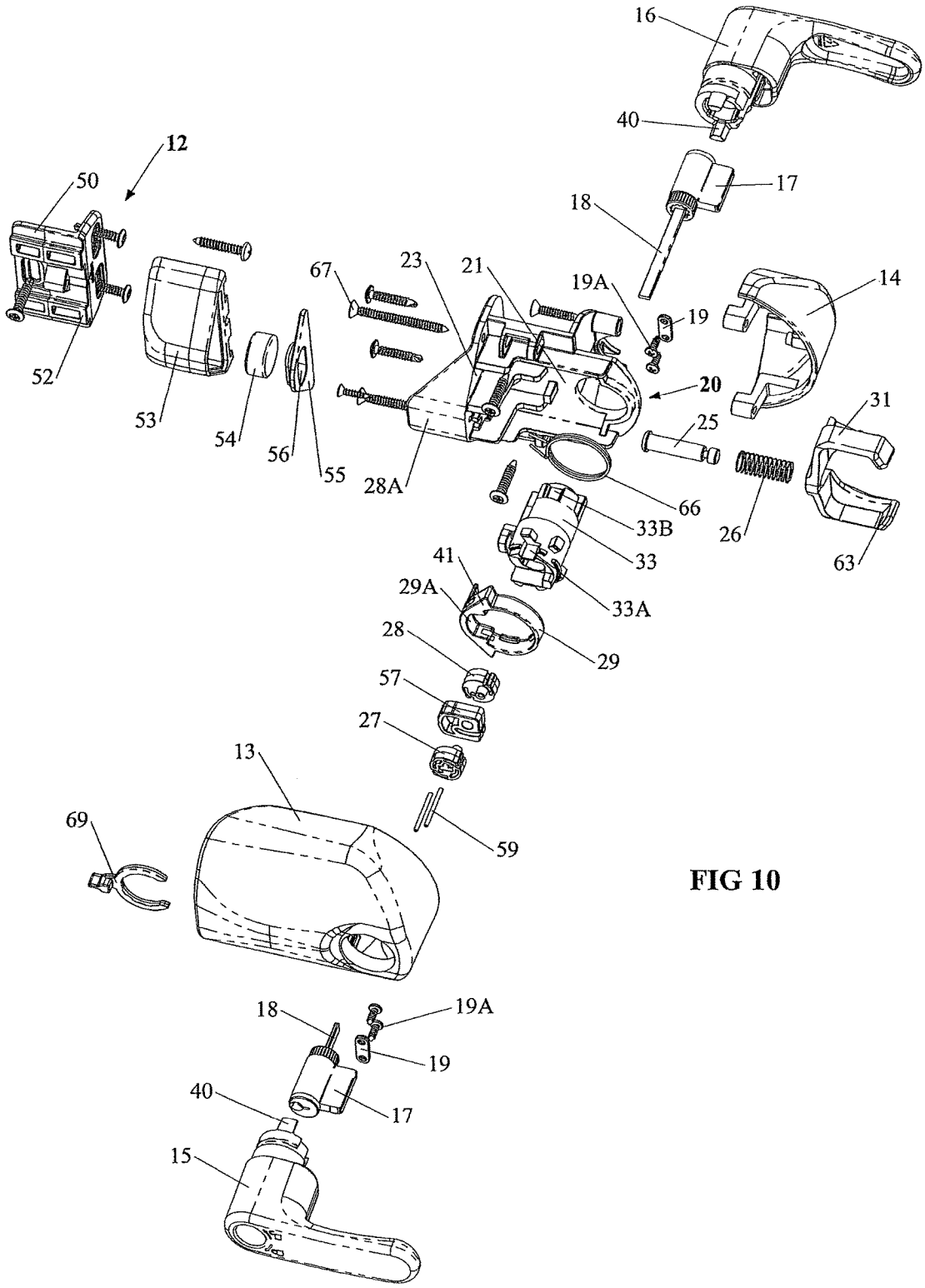
FIG. 10 is a partly exploded isometric view of a second embodiment.

Reference will now be made to FIG. 10 which shows a second embodiment of the disclosure which is similar to but a more practical version of the first embodiment. Like reference numerals have been used for like parts and only differences will be highlighted.

This embodiment shows the detail for mounting a conventional six pin cylinder lock 17 in each handle. The lock is inserted into the handle barrel with a lateral projection from each cylinder engaging in a corresponding cavity. A retaining plate 19 is inserted to close the cavity and secured by fixing screws 19A. Each cylinder lock has a projecting tab 18 being of rectangular cross-sectional shape for conventional purposes and of a length to suit engagement in respective rotor elements 27 and 28 to be associated with the actuating barrel 33 as described in more detail below.

Each handle is secured to the respective casing by a spring clip 69.

In this embodiment, the form of the mounting plate 20 is slightly different form, as illustrated, and the end wall 23 incorporates an integral security housing projection 28.

In this embodiment, the barrel 33, in place of the pivotal spring arms 34 of the first embodiment, has a moulded collar 29. Within the collar is mounted a tongue 57 which is secured in cooperating relationship to the front and rear rotors 27 and 28 which are secured, as described below, by two plain roll pins 59.

FIG. 10 shows in this embodiment that the handles have a pair of arcuate projecting tabs 40 for transmitting rotation. The front handle 40 has its tabs, on assembly, engaged in grooves 66 in a front portion of the barrel 33 whereas the rear handle 16 has its tabs 40 engaged in grooves 67 on the rear of the barrel 33. Thus rotation of either handle will rotate the barrel. However the collar 29 does not rotate unless the tongue 57 has engaged in a recess 29A in the collar. Engagement is achieved by unlocking. Unlocking the front lock turns the rotor 27 by virtue of engagement of the rectangular bar 18 in a central aperture in the rotor and, because of eccentric positioning of the pins 29, the tongue is displaced to the left as shown in FIG. 10 so its leading end engages in the cavity 29A in the collar. Thereafter rotation of the handle causes rotation of the collar 29 and upper or lower ear 41 then engages a lobe 63 of the C-shaped carriage to retract the latching pin.

Figure 11:
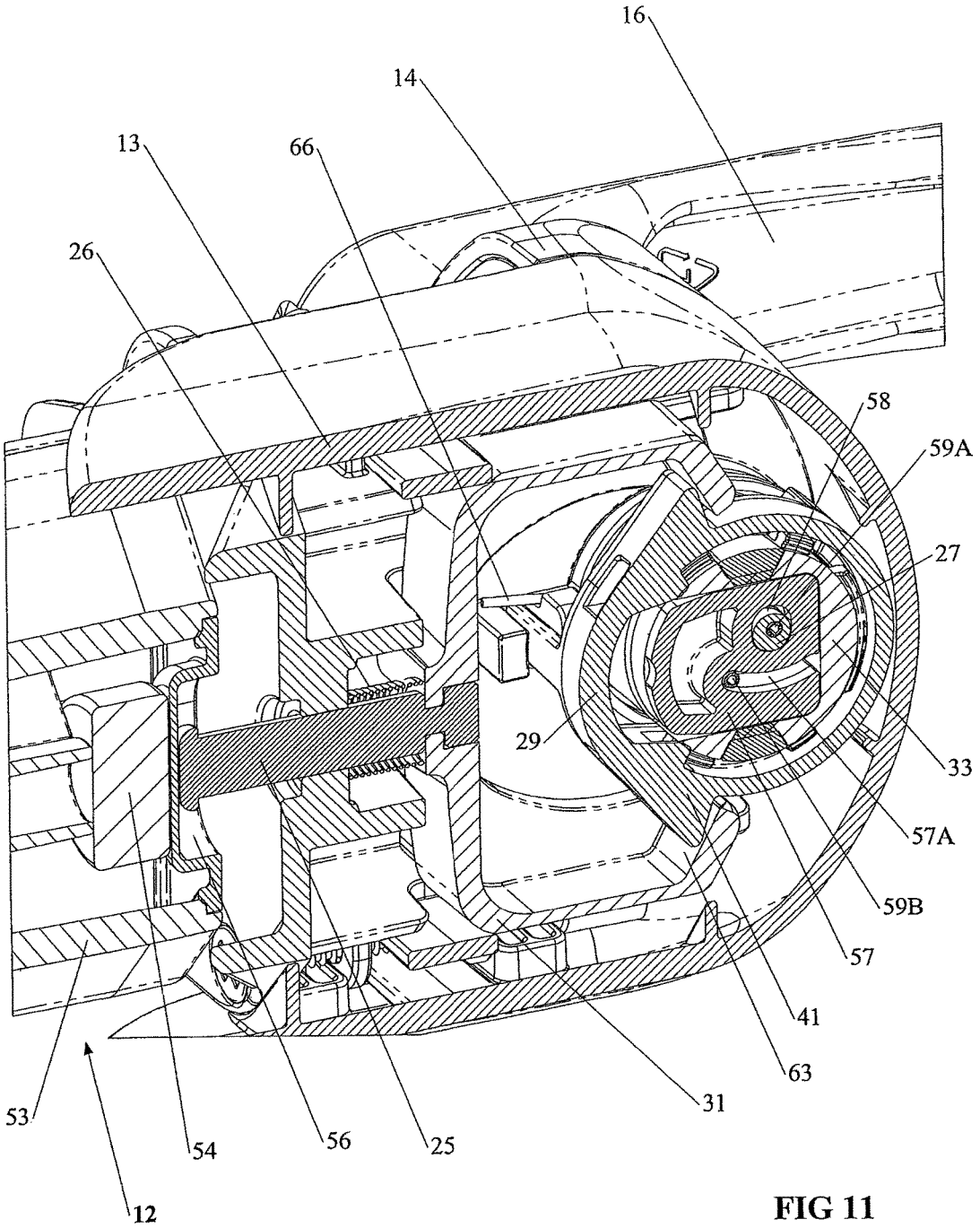
FIG. 11 is an isometric cross-sectional view of the embodiment of FIG. 10 when in the locked configuration and latch pin engaged by magnetic force into the receiving latch block.

Referring now to FIG. 11, which is an oblique view through a vertical central plane of the assembled device in a locked configuration, the configuration of the tongue 57 will be better appreciated. The collar 29 is mounted on and freely rotatable on the barrel 33 with the torsion spring 66, not shown in the drawing, located behind the collar 29. This biases the barrel to its normal or rest position. The tongue 57 has a slightly elongate aperture 58 elongated in the vertical direction and receiving from each side thereof cylindrical projections, each having a through bore, from the respective rotors 27 and 28. A first of the pins 59A is inserted through rotor 27 through its cylindrical projection and into the complimentary cylindrical protection of the rotor 28 lying behind the tongue. The second pin 59B is inserted through an aperture in the rotor 27, through an arcuate slot 57A in the tongue and into a corresponding aperture in the other rotor 28.

The collar 29 is rotatably mounted around the barrel and in the position shown in FIG. 11 the tongue 57 is in a retracted position so that rotation of the barrel and tongue by a handle does not transmit any rotation to the collar 41. The ears 41 lay adjacent the lobes 63 of the carriage. When the key mechanism is actuated to unlock the handle rotation of the rotor 27 occurs and the eccentrically disposed upper roll pin 59 occurs relative to the central pin 59B in an anti-clockwise direction thereby displacing the tongue to the left is shown in FIG. 11. This then causes the leading edge of the tongue to engage in the cavity 29A whereby any rotation of the handle thereafter rotates the barrel, the tongue and the collar thereby retracting the carriage 31 and the latch pin 25.

Figure 12:
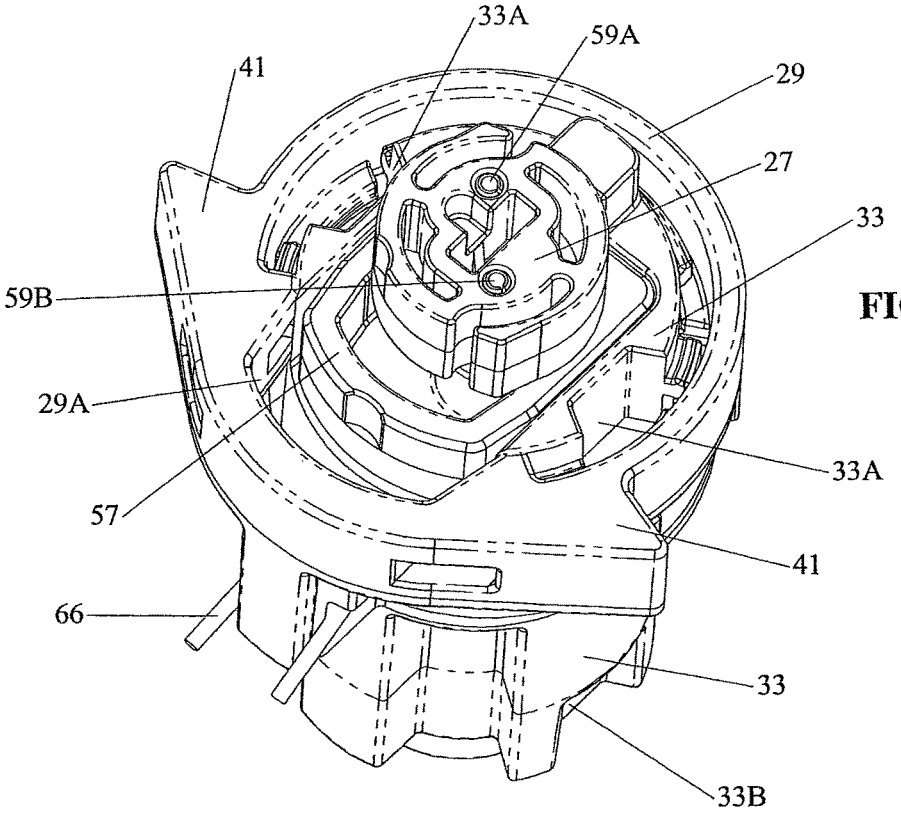
FIG. 12 is an isometric view on an enlarged scale of the rotary actuating a mechanism of the second embodiment shown on an enlarged scale and in a locked configuration.
Figure 13:
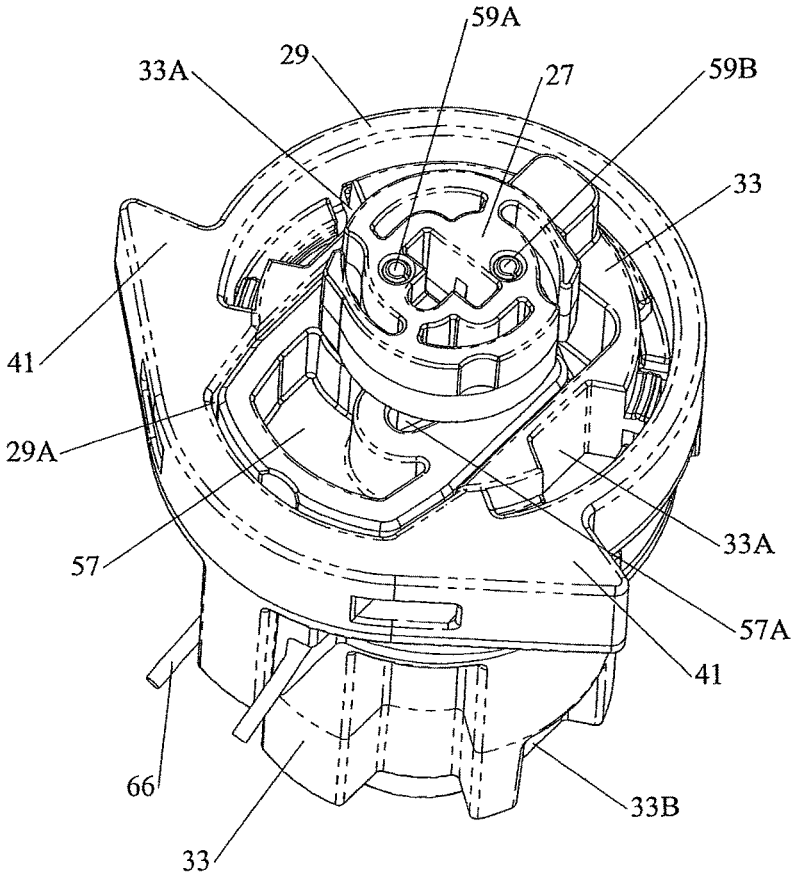
FIG. 13 is a view corresponding to FIG. 12 and showing an unlocked configuration.

FIGS. 12 and 13 show an enlarged scale in isometric view the assembled components in the locked and unlocked configurations.

Figure 14:
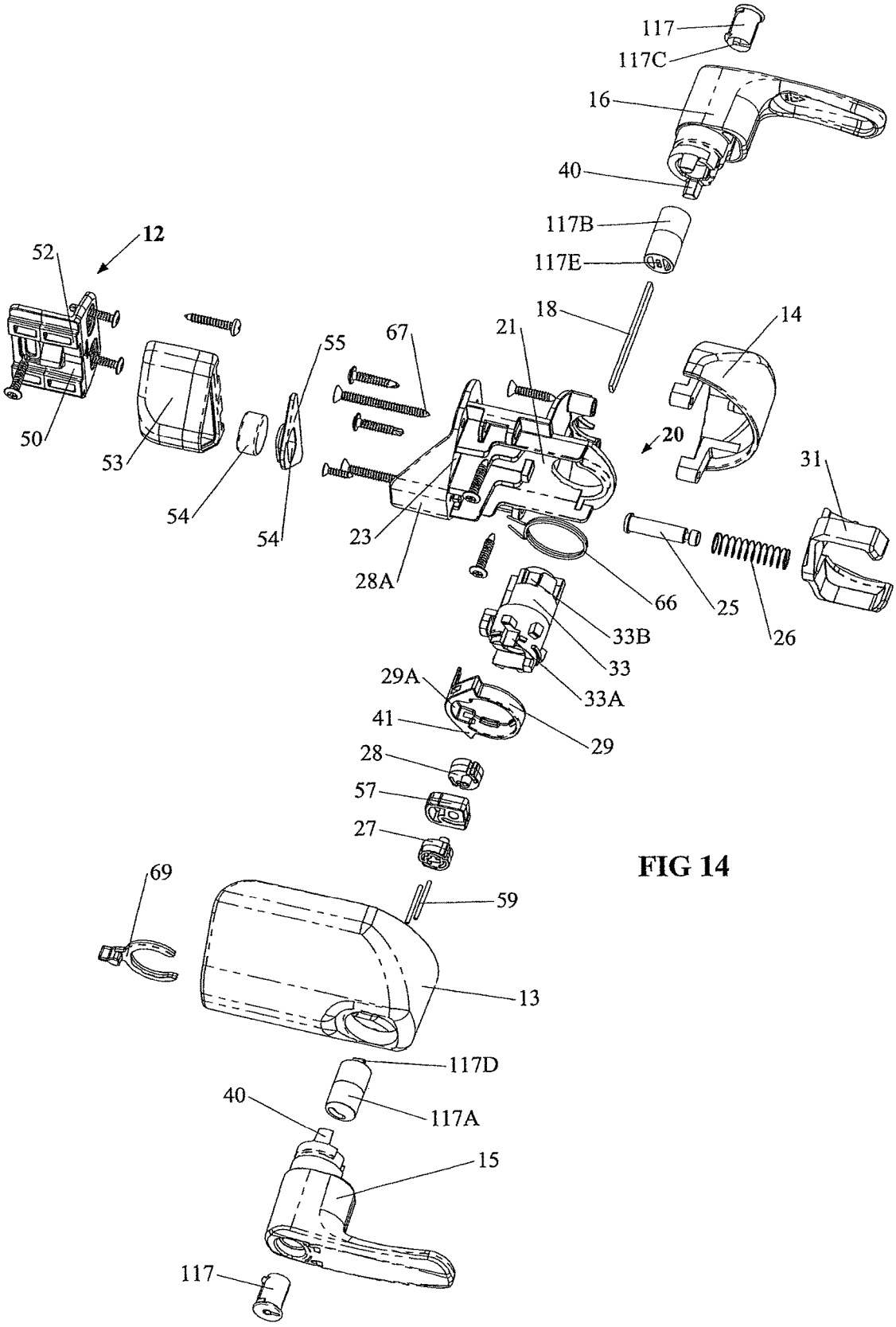
FIG. 14 is an exploded view of a third embodiment.

In place of the cylinder lock shown in FIG. 10 a wafer lock, which is less expensive and simpler, may be used. FIG. 14 is an exploded view of such an embodiment. A cylinder lock has an inherent lost motion effect but a wafer lock does not. Therefore when a wafer lock 117 is used, an adapter barrel 117A or 117B is utilised. Each adapter barrel has an eccentrically disposed arcuate slot facing the end of the wafer lock and accommodating and providing lost-motion for an eccentrically disposed cylindrical projection from the tip 117C on the rear end of the wafer lock (see rear wafer lock 117 in FIG. 14). In the case of the front adapter barrel 117A, it contains a short rectangular bar 117D for engaging in and rotating the front rotor 27 and in the case of the rear adapter barrel 117B there is a rectangular slot 117E in the adapter barrel for accommodating the end of an elongate rectangular drive bar 18 which has the effect of driving the rear rotor 29.

Figure 15:
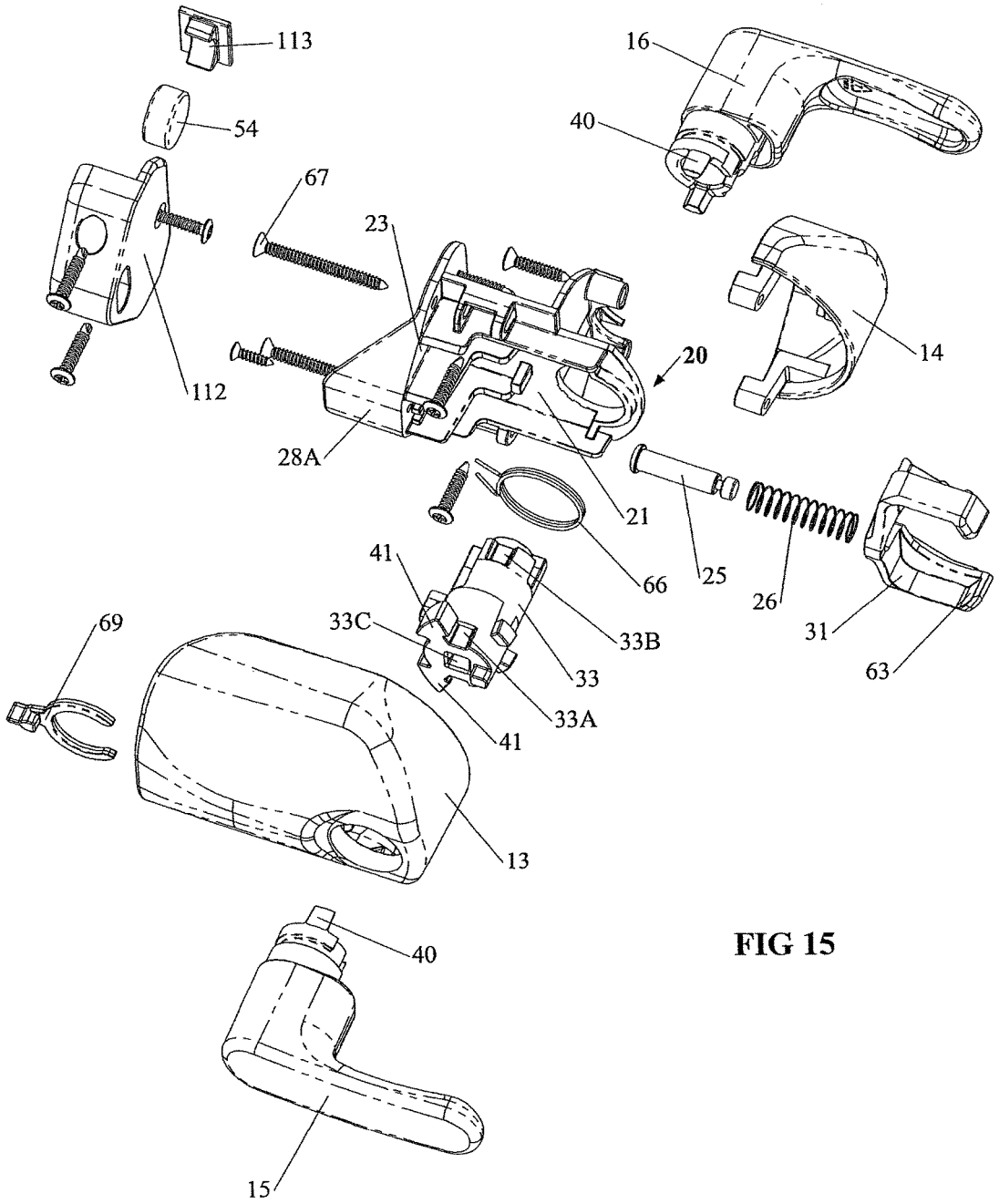
FIG. 15 is an exploded view of a fourth embodiment.

FIG. 15 is an exploded view of a third embodiment being a no-lock version wherein like parts have been given like reference numerals. Equivalent functionality applies without the complexity of locking options. In this embodiment an alternative form of non-adjustable latch block 112 is illustrated incorporating a cavity for the high performance magnet 54 which is retained by a cover plate 113.

The barrel 33 is simplified as an integral moulding incorporating ears 41 and at a forward end region a pair of grooves 33A for engaging with the projecting tabs 40 from the rear of the front handle for rotating the barrel. The rear portion of the barrel has further grooves 33B for similar engagement with the projecting tabs 40 from the rear handle 16. Upon assembly the barrel is located with the ears 41 located behind the lobes 63 of the carriage 31 and the embodiment operates by direct actuation of the carriage.

FIG. 15 also illustrates a square aperture 33C extending through the barrel for accommodating a conventional square drive bar of a rotary door knob which is an alternative to the use of the handles shown.

Figure 16:
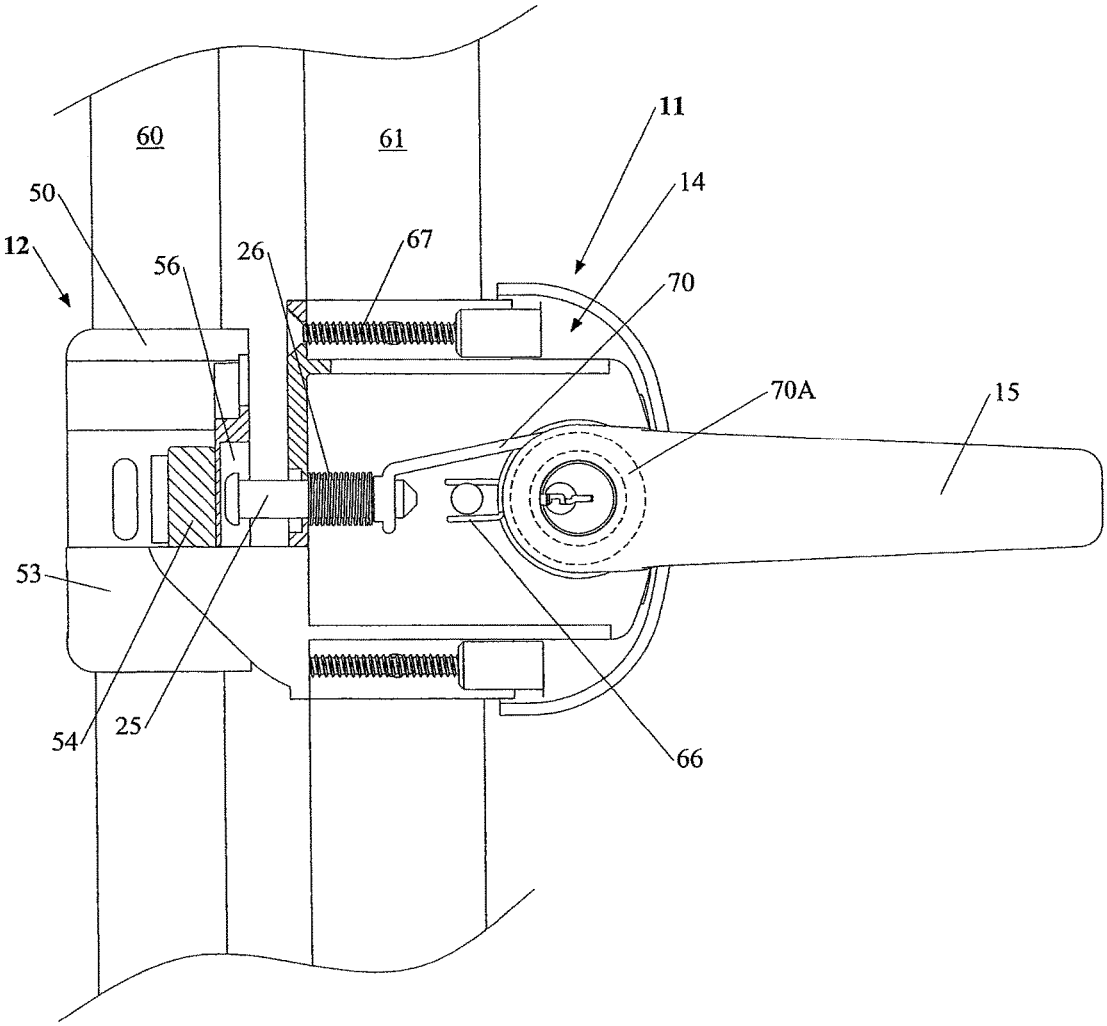
FIG. 16 is a view of a fifth embodiment of the invention utilizing a flexible line to provide a lost motion system.
Figure 17:
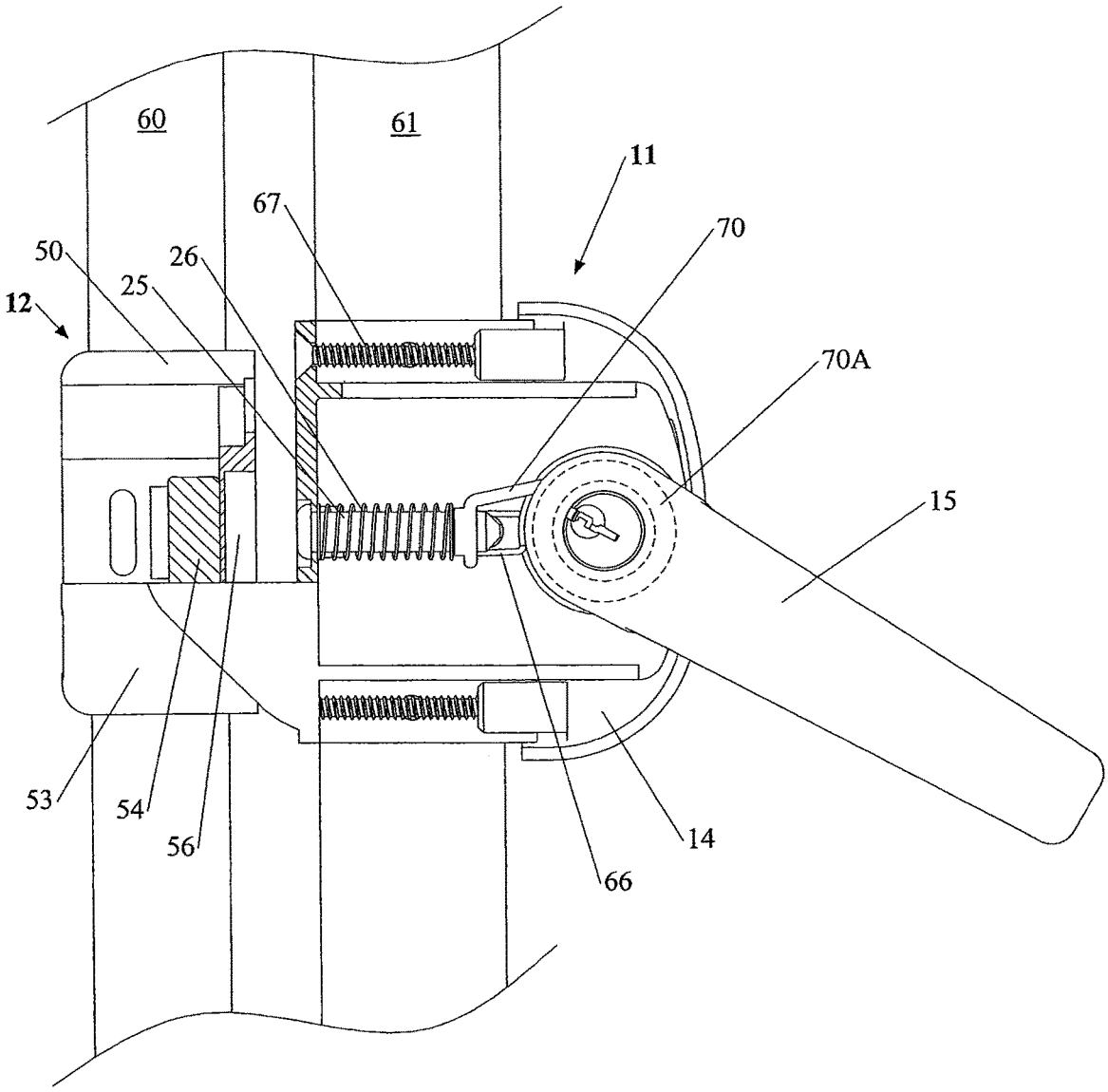
FIG. 17 is a view of the embodiment of FIG. 16 in which the handle has been depressed.
Figure 18:
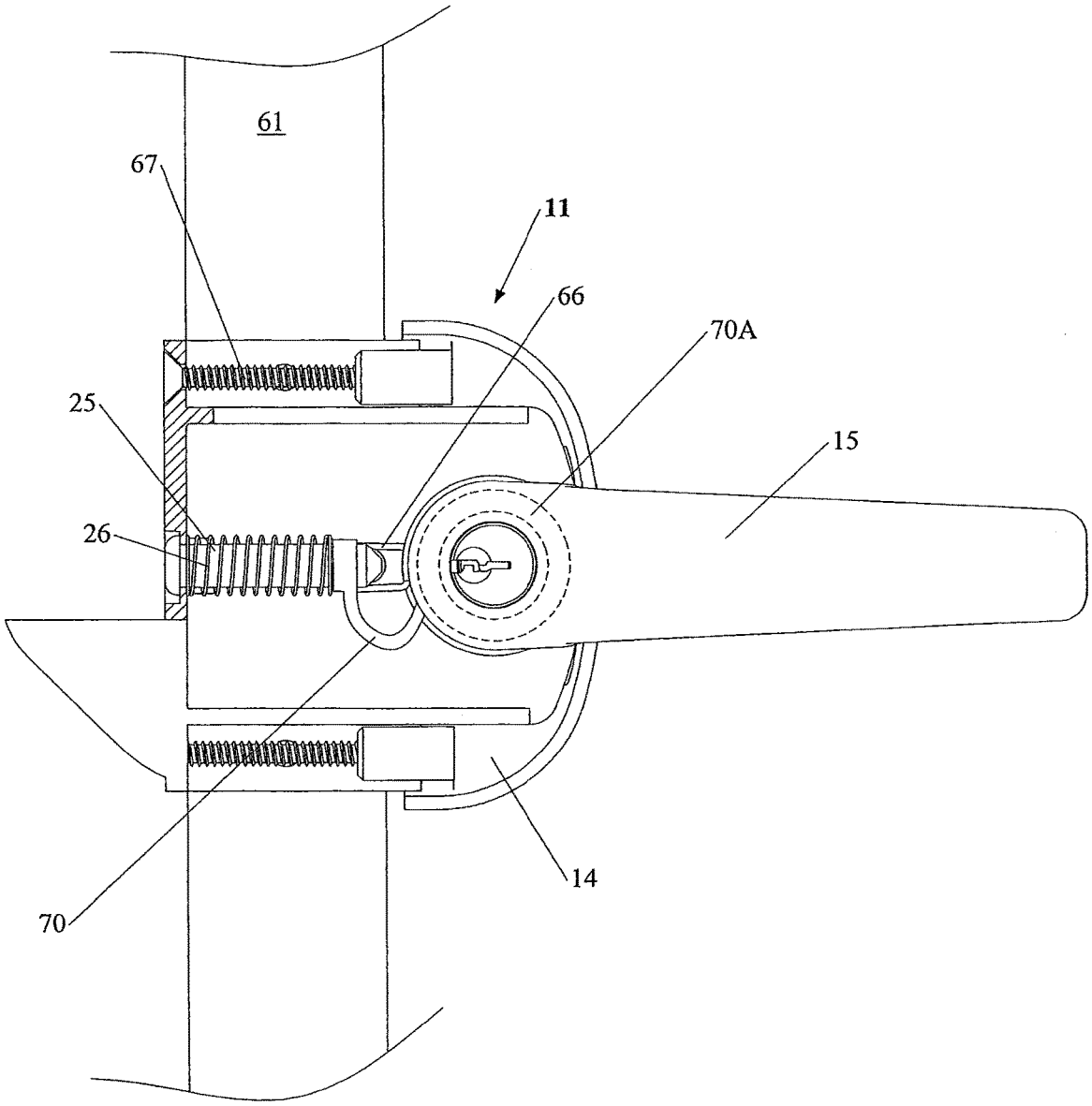
FIG. 18 is a view of the embodiment of FIGS. 16 and 17 in which the handle has returned to its neutral position after depression.

Referring now to the fifth embodiment of FIGS. 16-18, the drawings show an alternative connection system between the locking pin 25 and handle 15 to replace the actuating barrel 33 and the associated upper ear 41 and upper lobe 63 of the first embodiment. In this embodiment, there is provided a drum (not shown) around which is mounted a flexible line 70. The line 70 is connected to a right hand end portion of the pin 25. FIG. 16 shows the device in the same predetermined position as shown in FIG. 7. The locking pin 25 is drawn to the left and the flexible line 70 is drawn off the drum and becomes taut. In this configuration the handles 15 and 16 are released and arranged horizontally by the effect of the torsion spring 66.

Referring now to FIG. 17, downward rotation of the handle 15 has occurred, typically after manual unlocking and depression of the handle 15, causing the flexible line 70 to retract the locking pin 25, displacing it to the right against the force of the magnet 54. The pin 25 is thus retracted to the position shown in FIG. 17 and is removed from engagement with the cavity 56 of the receiving block. The gate can then be swung open, and when the handle is released, there is no magnetic field influence on the locking pin 25. The pin 25 which is biased to the right by the biasing spring 26. FIG. 18 shows the sagging of the flexible line 70 when the handle 15 is released and returns to its original position under the influence of the torsion spring 66.

In a similar way to previous embodiments, when the door or gate is returned to its closed position, the configuration of FIG. 16 is attained once again.

Figure 19:
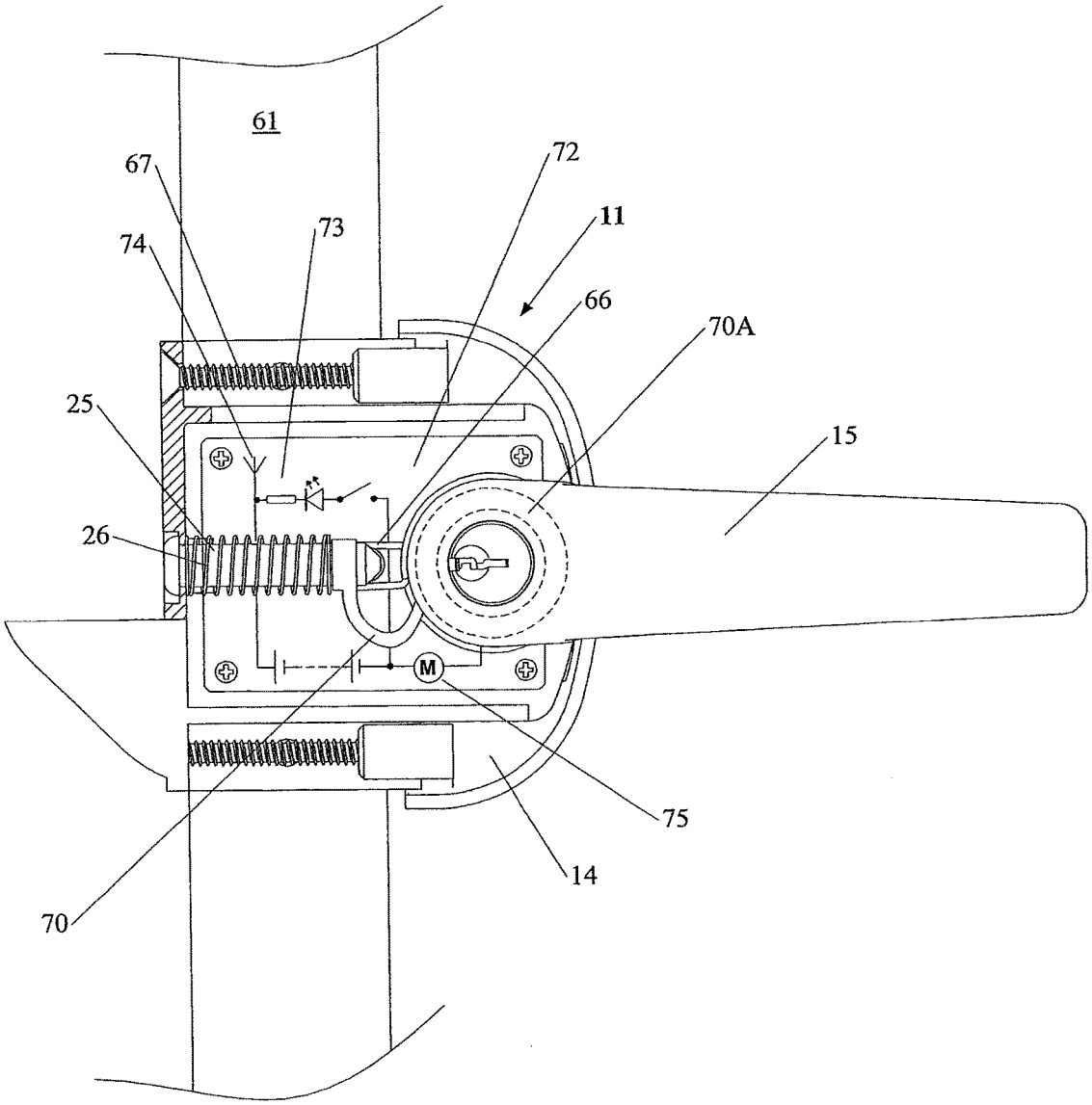
FIG. 19 is a schematic view of the sixth embodiment modified for remote actuation.

Referring now to the adaptation of FIG. 19, the parts are shown schematically with provision for a remote actuator 72 including an electrical actuator 72 having a set of connections 73 when it is to be hardwired to a circuit closing device or an aerial 74 where a wireless signal is to be received and interpreted to actuate the device. The circuit includes a source of electrical power such as a transistor radio battery sufficient to drive either a solenoid or a small motor 75 which drives the drum 70A. Thus remote actuation can occur to remotely actuate the gate lock.

Figure 20:
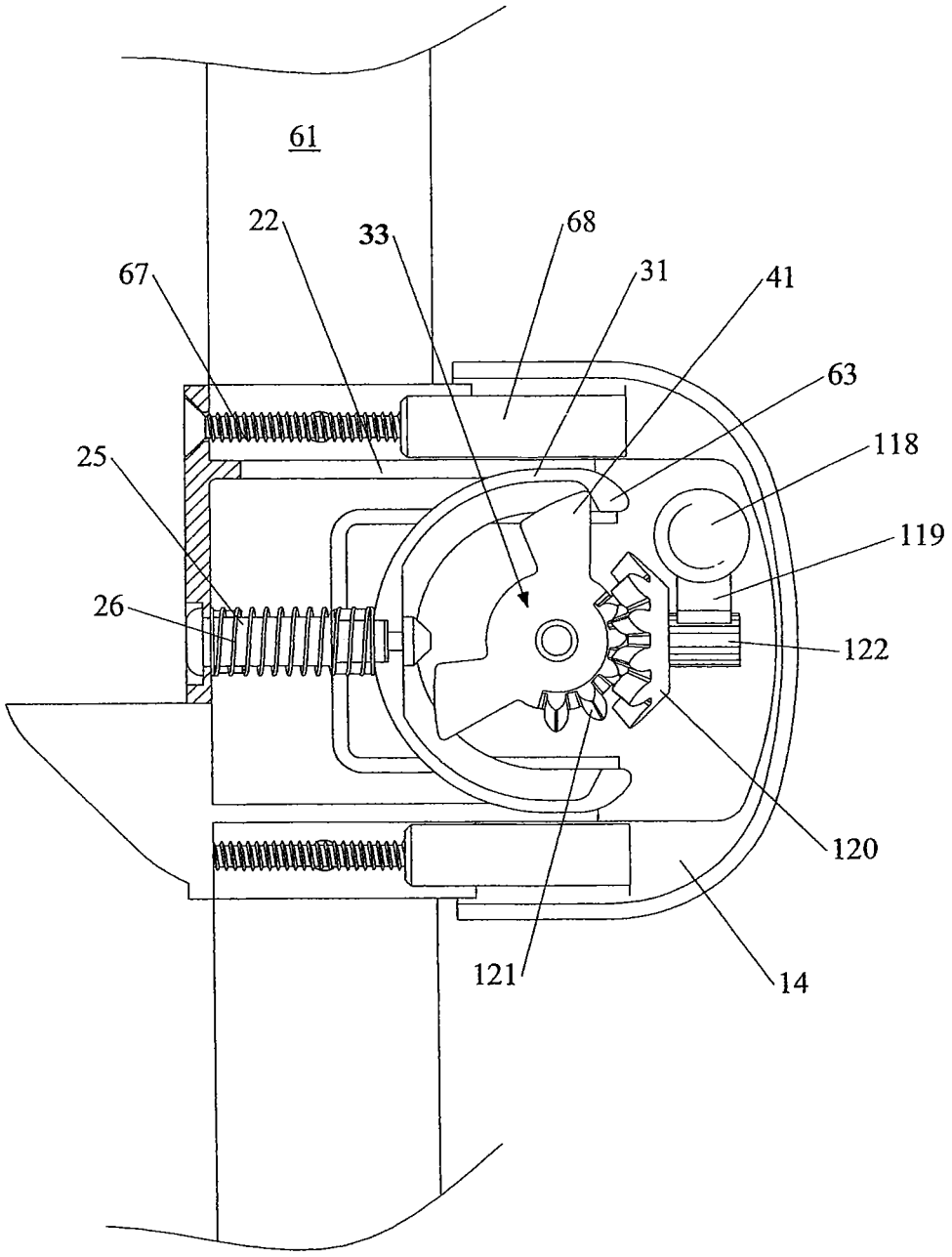
FIG. 20 is a front part-sectional view of a seventh embodiment when actuated to retract a latch pin.
Figure 21:
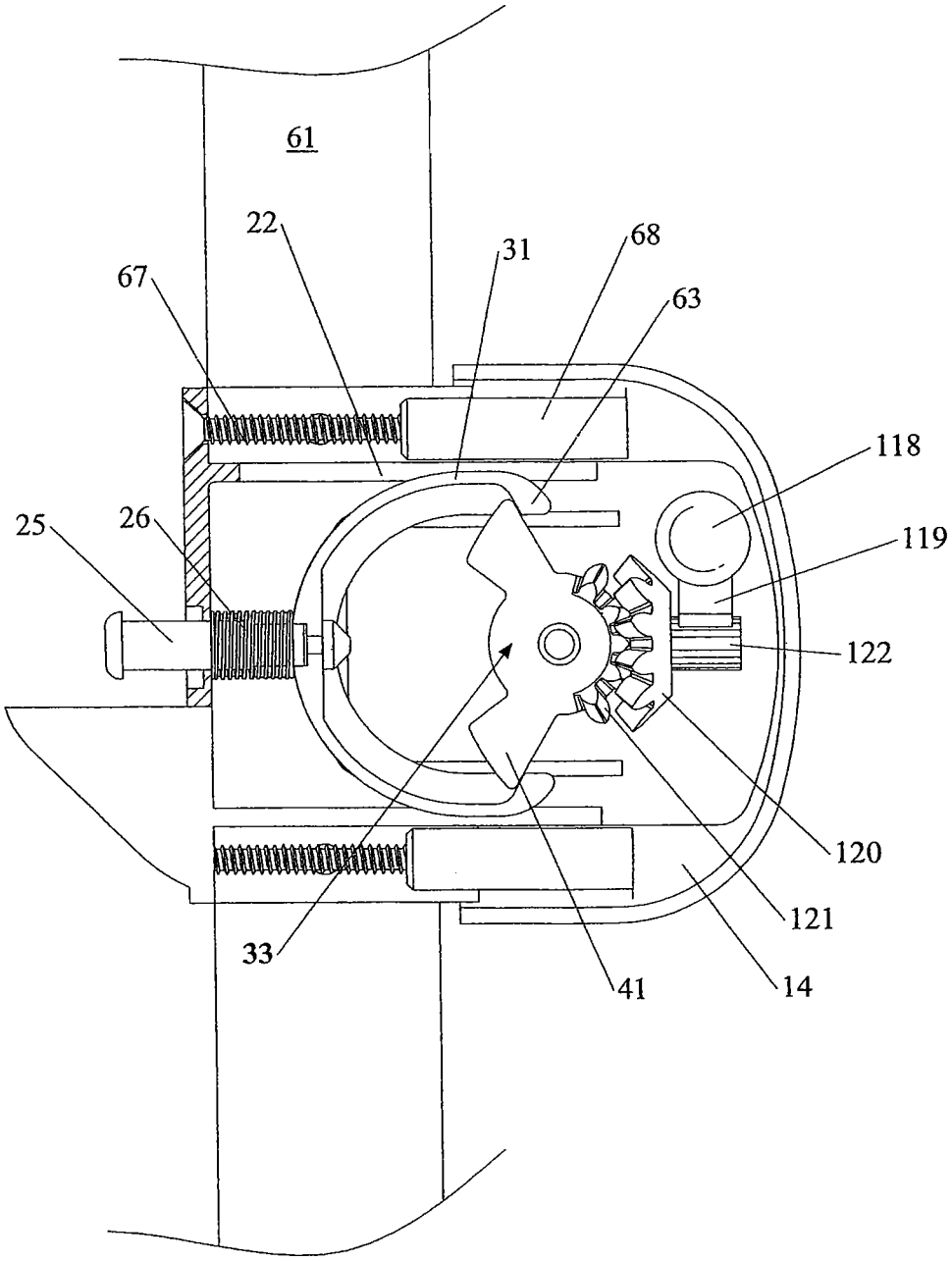
FIG. 21 is a view of the embodiment of FIG. 20 when the actuator is released and the gate-closing position has been achieved and the latch pin magnetically displaced to a latching portion.

Referring now to the seventh embodiment of FIGS. 20 and 21, like reference numerals have been used for like parts. This embodiment differs from the first embodiment by responding to rectilinear push-button operation which rotates a modified barrel 33 which otherwise functions as in the first embodiment.

Push button 118 has a gear rack 119 engaging a pinion 122 having a horizontal axis aligned with the axis of the latch pin 25. The button 118 is slidably mounted in the housing of the device and is biased by a spring (not shown) to its outward or projecting position. When the button is depressed, rack 119 rotates pinion 122 which carries a crown gear 120 in constant mesh with a gear 121 on the barrel 33 so that the barrel rotates. Upper ear 41 engages the upper lobe 63 of the carriage 31 to retract it and the latch pin 25 to the position shown in FIG. 20.

After opening of the gate on which the device is mounted, and upon release of the button, the barrel and button return to an initial position, corresponding to that shown in FIG. 21, but with the carriage 31 and latch pins remaining in the displaced position shown in FIG. 20.

When the gate is re-positioned to its closing position, the magnet in the receiving unit (not shown) attracts the latch pin to the latching position shown in FIG. 21.

The magnetic door latch illustrated in the FIGS. 22-28 comprises a first unit 210 in the form of a handle actuated latch adapted to be mounted on a door 262 and a complementary second unit 212 adapted to be mounted on a gate post 260.

Figures 22, 23:
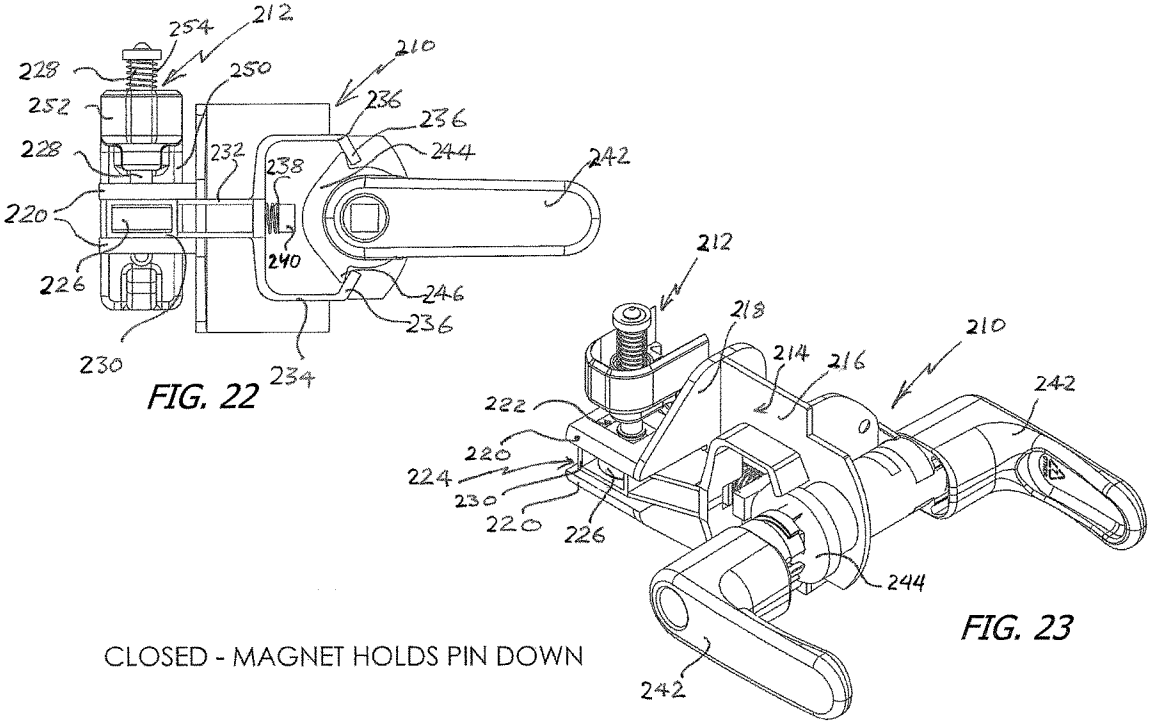
FIG. 22 is a front elevational view illustrating an embodiment when in use in a latching situation, exterior housings of the device being omitted for clarity and for depicting the operational components.
FIG. 23 is an isometric view of the latch of FIG. 22 in the latching position.
Figure 24:
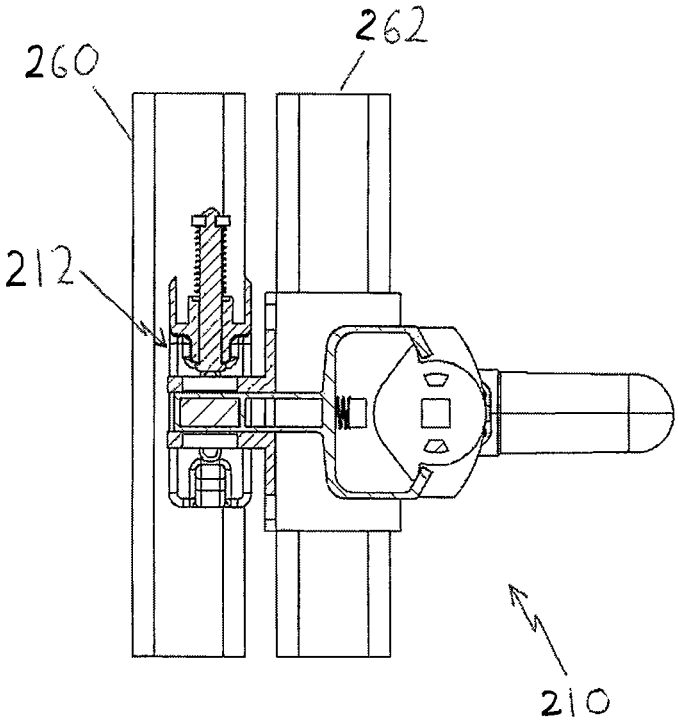
FIG. 24 is a sectional front elevation through the central plane of the latch of FIG. 22.
Figure 25:
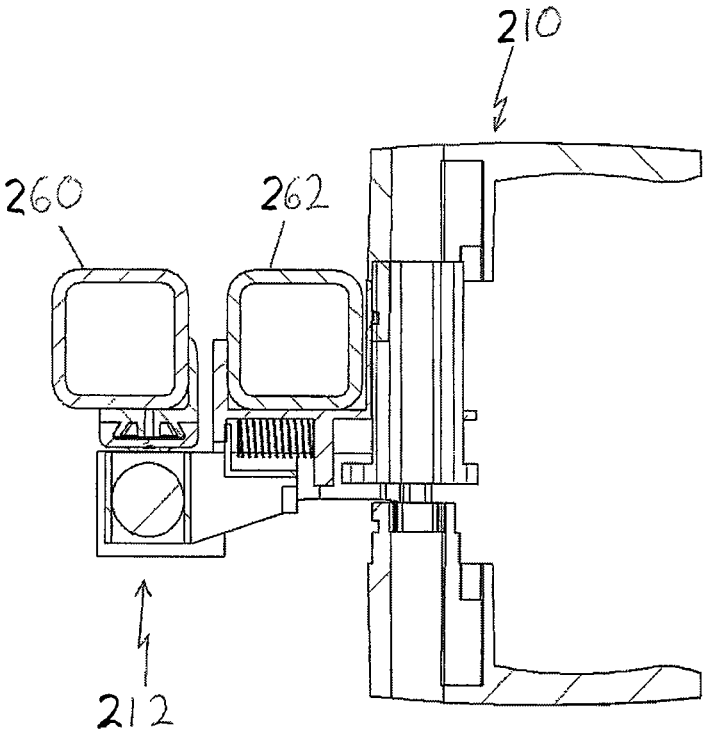
FIG. 25 is a sectional plan view through the central plane of the latch of FIG. 22.

The handle unit 210 has a support body 214 consisting of a plate 216 and a cross wall 218 adapted to be mounted by screws onto a door 262 and supporting the mechanisms of the unit. A forked tongue 220 projects forwardly from the cross wall 218 and defines within it a square shape latching cavity 222 in the upper region and a central zone 224 for receiving a retractable high coercivity permanent magnet 226. FIG. 22 shows the latching position in which the juxtaposition of the magnet 226 and a complementary magnetically attractable pin 228 of unit 212 are interengaged for latching purposes.

The permanent magnet 226 is sealed for protection in a magnet carrier 230 which is attached to a retractable carriage 232 having at the end remote from the magnet C-shaped end fitting 236. The carriage 32 is biased to the left hand position shown in FIGS. 22 and 23 by a helical compression spring 238 acting between a fixed abutment wall 240 and a portion of the carriage not shown in the drawings.

Figure 27:
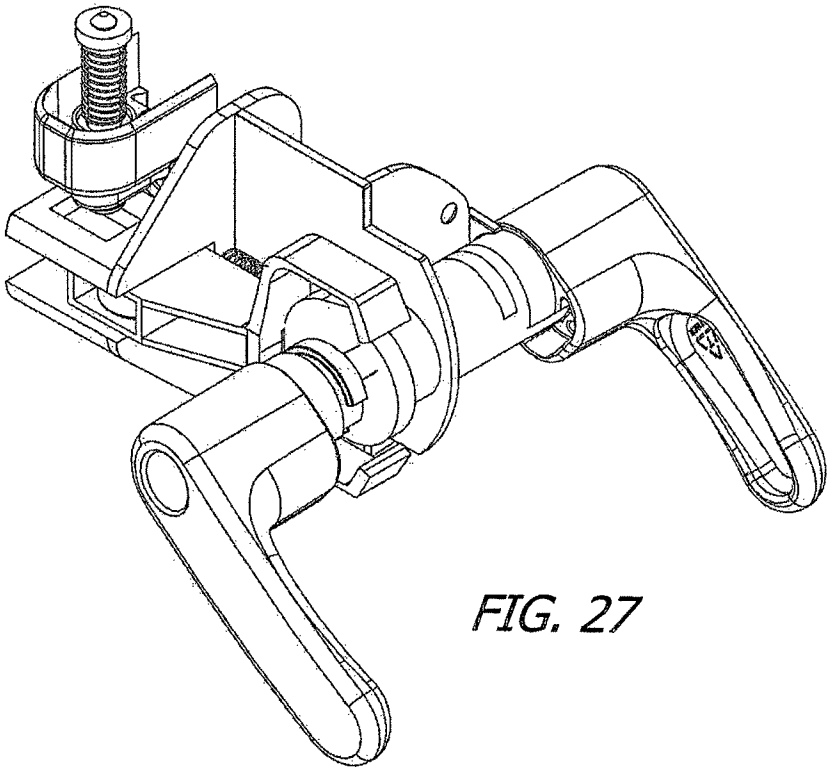
FIG. 27 is an isometric view of the latch of FIG. 26.
Figure 26:
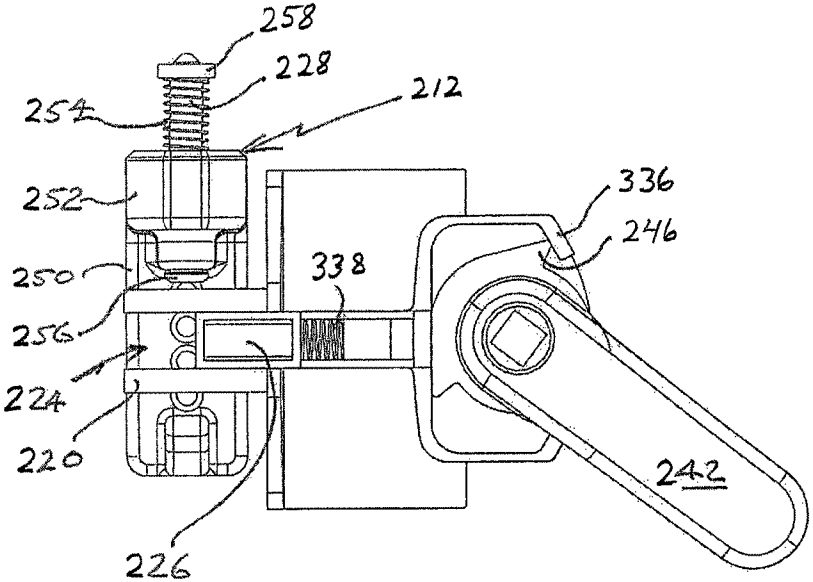
FIG. 26 is a front elevation of the latch FIG. 22 with the handle actuated to retract the magnet for unlatching.
Figure 28:
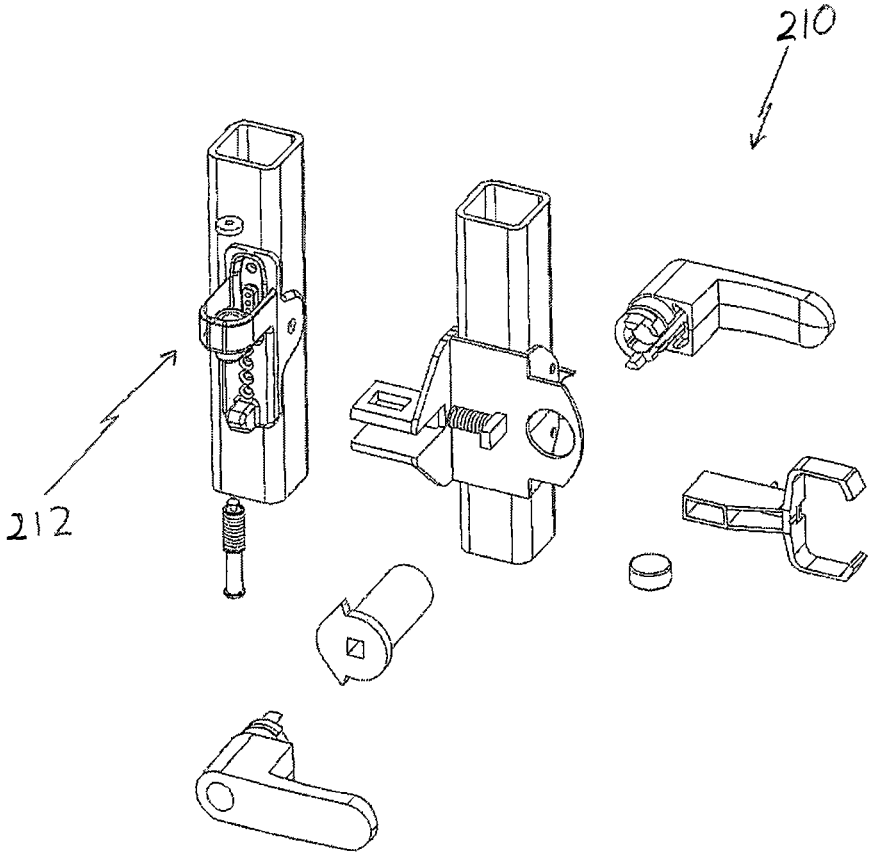
FIG. 28 is an exploded isometric view of the latch of FIG. 22.

Rotabably mounted operating handles 242 are secured to the mounting plate 216 and a drive plate 244 is secured to the inner shaft portion associated with the handles whereby on rotation of either handle in either an anti-clockwise or clockwise direction one of the ears 246 of the drive plate engages one of the end tips 236 to retract the carriage 232 to the position shown in FIGS. 26 and 27 thereby compressing the helical spring 238 and retracting the magnet 230 so that the magnetic attracting forces with the pin 228 is insufficient to overcome the biasing of the pin whereby it retracts, latching no longer occurs and the door can be opened from the position of the parts shown in FIGS. 26 and 27.

The second unit 212 comprises a mounting plate 250 for fixing the unit to a door post 260 and providing a body of 252 for mounting a vertically movable latching pin 228 which is biased to its upward retracted position by helical biasing spring 254. The pin's movement is limited by its latching head 256 in the upper position abutting an end wall of the mount 252, the upper end of the spring having a collar 258 with the helical compression spring acting between the collar and the wall of the body 252.

Figure 29:
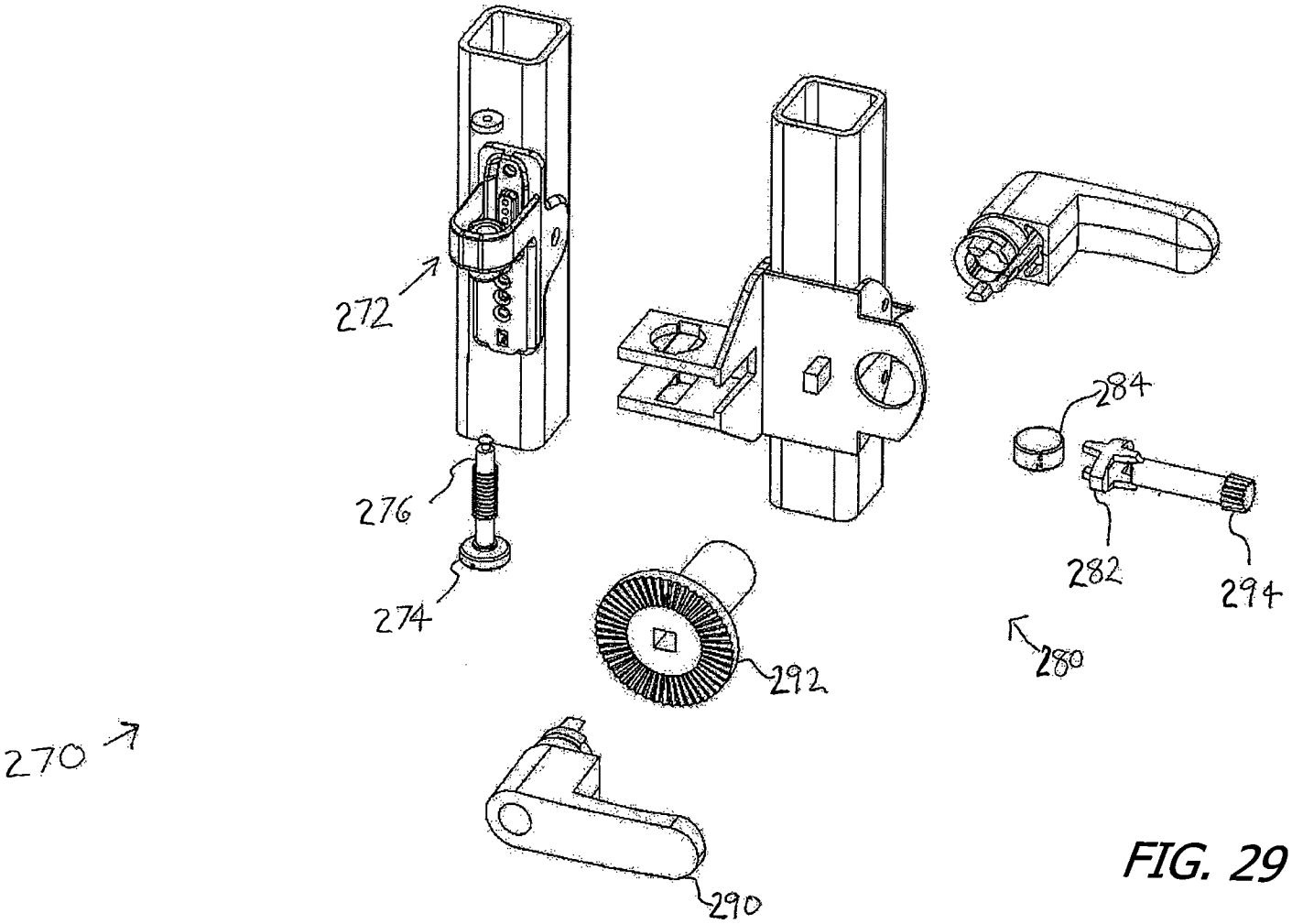
FIG. 29 is an exploded perspective view of a second embodiment with a rotary magnetic mounting for unlatching.
Figure 30:
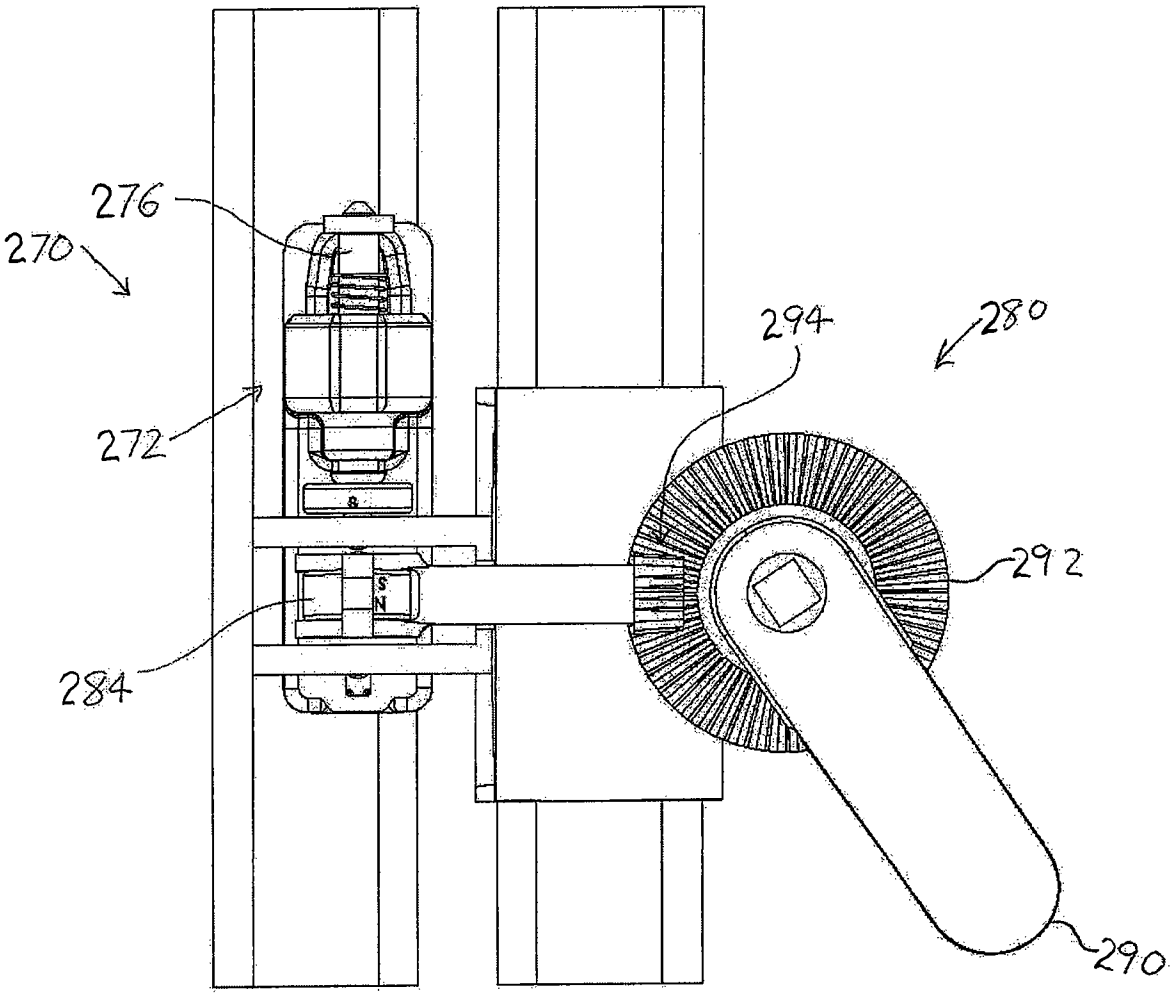
FIG. 30 is a front elevational view of the embodiment of FIG. 29.

FIGS. 29 and 30 show another embodiment of a magnetic door latch generally indicated by the numeral 270, comprising a handle or first unit 280 and a complimentary second unit 272. The second unit 272 has a permanent magnet 274 associated with a retractable element 276. The first unit 280 provides a rotatable mounting 282 for its permanent magnet 284 with biasing, such as a spring or gravitational biasing, to bias the magnet 284 to have its polarity arranged to attract the magnet 274 and thus the retractable element 276 or pin of the second unit 270 in the latching configuration but rotatable to reverse the polarity, and thus repel magnet 274, for unlatching. The magnet is rotated by turning the handle 290 which drives the magnet 284 through a pinion 292 and ring gear 294 arrangement.

We claim:

1. A magnetic latch comprising first and second units adapted to interengage in use in latching engagement to hold a moveable structure in a closed position relative to another structure, the latch having a magnetic arrangement in the first and second units to cause components thereof to be displaced to establish latching engagement under magnetic forces when the components are in a juxtaposition for latching in the closed position, the first unit having (a) a latching structure comprising a housing defining a latching cavity and a central zone adjacent the latching cavity, the latching cavity co-operates in latching engagement with the second unit;

(b) a displaceable magnet being a component of the magnetic arrangement and biased towards a latching position wherein the magnet is positioned within the central zone;

(c) an actuator operable to displace the magnet from the central zone against the biasing to an unlatching position, and the second unit having a retractable element having a further component of the magnetic arrangement which is biased towards a retracted position, the retractable element having a head to co-operate in latching engagement with the latching cavity of the first unit;

wherein the magnet is displaceable along a first path, and the retractable element is displaceable from the retracted position along a second path transverse to the first path in response to magnetic attracting forces from the magnet and where the bias of the retractable element is less than the magnetic attraction between the magnet and the retractable element;

whereby, when the components are in the juxtaposition for latching in the closed position with the magnet disposed in the central zone in the latching position, magnetic attraction between the components of the magnetic arrangement occurs to cause the retractable element to act against its bias to establish engagement of the head of the retractable element with the latching cavity of the housing of the latching structure, and when the magnet is displaced from the central zone of the housing to the unlatching position, the magnetic attraction is removed such that the retractable element is biased to the retracted position to disengage the head of the retractable element from the latching cavity of the housing of the latching structure in response to the loss of magnetic attraction to allow the moveable structure to be moved from the closed position to an open position.

2. A magnetic latch as claimed in claim 1, wherein the first unit is adapted to be mounted on a gate.

3. A magnetic latch as claimed in claim 1, wherein the second unit is adapted to be mounted on a gate post and wherein the retractable element is adapted to move slideably in a vertical direction when installed and is biased in an upward direction by a spring towards the retracted position.

4. A magnetic latch as claimed in claim 1, wherein the actuator is rotatably mounted in the first unit.

5. A magnetic latch as claimed in claim 1, wherein the magnet is a permanent magnet.

6. A magnetic latch as claimed in claim 1, wherein the second unit comprises a first biasing device to bias the retractable element into the retracted position, wherein the strength of the first biasing device is such that the retractable element is biased to move to the retracted position upon displacement of the magnet to the unlatching position solely under influence of the first biasing device.

7. A magnetic latch as claimed in claim 6, wherein the first unit comprises a second biasing device to bias the displaceable magnet into the latching position.

8. A magnetic latch as claimed in claim 7, wherein displacement of the magnet against the bias of the second biasing device causes the retractable element to be biased by the first biasing device towards the retracted position without the need of intervention from the user.

9. A magnetic latch as claimed in claim 7, wherein displacement of the magnet against the bias of the second biasing device causes the retractable element to be biased by the first biasing device towards the retracted position without the need of a user actuator.

10. A magnetic latch as claimed in claim 1, wherein when said components are in the juxtaposition for latching in the closed position the magnetic arrangement causes the retractable element to act against its bias to establish engagement of the retractable element and the latching structure without the need of intervention from the user.

11. A magnetic latch comprising first and second units adapted to interengage in use in latching engagement to hold a moveable structure in a closed position relative to another structure;

the first unit having:

a latching structure comprising a housing defining a latching cavity and a central zone adjacent the latching cavity, the latching cavity co-operates in latching engagement with the second unit;

a displaceable magnet that is displaceable along a first path; and a second biasing means to bias the displaceable magnet to a latching position within the central zone, the displaceable magnet being displaceable from the central zone relative to the housing and the latching cavity against the bias of the second biasing means to a retracted position in operation;

the second unit having:

a retractable element having an engagement head to co-operate in latching engagement with the latching cavity of the first unit; and a first biasing means to bias the retractable element to a retracted position;

the retractable element being displaceable from the retracted position along a second path transverse to the first path in response to magnetic attracting forces from the magnet and where the bias of the first biasing means is less than the magnetic attraction between the magnet and the retractable element;

whereby, when the moveable structure and the another structure are in the closed position, the juxtaposition of the displaceable magnet disposed in the central zone of the housing in the latching position and the retractable element causes the retractable element to move against the bias of the first biasing means such that the engagement head is positioned within the latching cavity to establish the latching engagement;

the magnetic latch further comprising a retraction means selectively operable to retract the displaceable magnet to remove magnetic attraction between the displaceable magnet and the retractable element, thereby permitting the structures to be moved from the closed position to an open position.

12. A magnetic latch as claimed in claim 11, wherein the strength of the first biasing means is such that the retractable element is biased to move to the retracted position upon displacement of the displaceable magnet to the retracted position solely under influence of the biasing means.

13. A magnetic latch as claimed in claim 11, wherein displacement of the displaceable magnet against the bias of the second biasing means causes the retractable element to be biased by the first biasing means towards the retracted position without the need of intervention from the user.

14. A magnetic latch as claimed in claim 11, wherein when said components are in the juxtaposition for latching in the closed position, the magnetic arrangement causes the retractable element to act against the bias of the second biasing means to establish engagement of the retractable element and the latching structure without the need of intervention from the user.

15. A magnetic latch having first and second units adapted to interengage in use in latching engagement to hold a moveable structure in a closed position relative to another structure, the latch having a magnetic arrangement in the first and second units to cause components thereof to be displaced to establish latching engagement under magnetic forces when the components are in juxtaposition for latching at the closed position, the first unit having;

(a) a latching structure comprising a housing having a latching cavity and a central zone adjacent the latching cavity, the latching cavity co-operates in latching engagement with the second unit;

(b) a displaceable magnet biased towards a latching position wherein the displaceable magnet is positioned in the central zone of the housing and in which magnetic attraction occurs for establishing latching engagement with the second unit;

(c) an actuator operable to displace the displaceable magnet from the central zone in the latching position relative to the latching cavity of the housing against the bias to cause removal of the magnetic attraction for unlatching;

the second unit having;

a retractable element having an engagement head to co-operate in latching engagement with the latching cavity of the first unit, the retractable element being biased towards a retracted position;

wherein the displaceable magnet is displaceable along a first path, and the retractable element is displaceable along a second path transverse to the first path in response to magnetic attracting forces from the magnet and where the bias of the retractable element is less than the magnetic attraction between the magnet and the retractable element;

whereby, when the displaceable magnet is displaced to the latching position disposed in the central zone of the housing, magnetic attraction occurs between the displaceable magnet and the retractable element to cause the retractable element to act against its bias to establish engagement of the engagement head within the latching cavity of the housing, and when the magnet is displaced away from the latching position and the central zone, the magnetic attraction is removed such that the retractable element is biased to the retracted position to disengage the engagement head of the retractable element from the latching cavity of the housing in response to the loss of magnetic attraction to allow the moveable structure to be moved from the closed position to an open position.

16. A magnetic latch as claimed in claim 15, further comprising a first biasing device to bias the retractable element into the retracted position, wherein the strength of the first biasing device is such that the retractable element is biased to move to the retracted position upon removal of the magnetic attraction for unlatching solely under influence of the biasing device.

17. A magnetic latch as claimed in claim 16, further comprising a second biasing device to bias the displaceable magnet towards the position in the central zone in which magnetic attraction occurs for establishing latching engagement with the second unit.

18. A magnetic latch as claimed in claim 17, wherein during unlatching, displacement of the displaceable magnet against the bias of the second biasing device away from the central zone causes the retractable element to be biased by the first biasing device towards the retracted position without the need of intervention from the user.

19. A magnetic latch as claimed in claim 18, wherein during unlatching, displacement of the displaceable magnet against the bias of the second biasing device away from the central zone causes the retractable element to be biased by the first biasing device towards the retracted position without the need of a user actuator.

* * * * *